US006958761B2

(12) United States Patent
Yim et al.

(10) Patent No.: US 6,958,761 B2
(45) Date of Patent: Oct. 25, 2005

(54) METHOD OF FAST PROCESSING IMAGE DATA FOR IMPROVING VISIBILITY OF IMAGE

(75) Inventors: Sang-Hoon Yim, Seoul (KR); Yoon-Hyoung Cho, Suwon (KR); Dong-Ju Woo, Seongnam (KR); Su-Yong Chae, Kwacheon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 333 days.

(21) Appl. No.: 10/405,909

(22) Filed: Apr. 3, 2003

(65) Prior Publication Data

US 2004/0085333 A1 May 6, 2004

(30) Foreign Application Priority Data

Nov. 4, 2002 (KR) ..... 10-2002-0067967

(51) Int. Cl.[7] ..... G09G 5/02
(52) U.S. Cl. ..... 345/698
(58) Field of Search ..... 345/698

(56) References Cited

U.S. PATENT DOCUMENTS 4,484,347 A * 11/1984 Kashioka ..... 382/296
5,341,153 A 8/1994 Benzschawel et al.
5,426,723 A * 6/1995 Horsley ..... 345/428
5,554,911 A 9/1996 Nakayama et al.
5,751,272 A 5/1998 Silverbrook et al.
5,796,378 A 8/1998 Yoshida et al.
5,856,823 A 1/1999 Kimoto et al.
5,870,075 A 2/1999 Yamazaki et al.

(Continued)

OTHER PUBLICATIONS

"Interpolated *M*th–Band Filters for Image Size Conversion," by Seungjoon Yang and Truong Q. Nguyen, in IEEE Transactions on Signal Processing, vol. 50, No. 12, Dec. 2002, pp. 3028–3035.

*Primary Examiner*—Bipin Shalwala
*Assistant Examiner*—Tom Sheng
(74) *Attorney, Agent, or Firm*—Robert E. Bushnell, Esq.

(57) ABSTRACT

A method of processing image data to generate output image data for driving a display panel is provided. In the method, a new resolution for input image data is set according to a resolution of the display panel. A first virtual screen is divided into a plurality of pixel areas according to the new resolution set for the input image data. A second virtual screen having a sub-pixel array structure of the display panel is superimposed on the first virtual screen. A mask wider than a sub-pixel area on the superimposed second virtual screen is laid on each sub-pixel area. An area ratio of the area of each pixel portion on the first virtual screen included in each mask to the area of the mask is obtained and set. The new resolution and the area ratios are applied to a driving device of the display panel. The input image data having an original resolution is transformed into image data having the new resolution. The sum of the results of multiplying an area ratio of the area of each pixel portion on the first virtual screen included in each mask by the transformed image data of the pixel areas, respectively, is generated as output image data of a sub-pixel corresponding to the mask.

57 Claims, 21 Drawing Sheets

U.S. PATENT DOCUMENTS 5,920,298 A 7/1999 McKnight
5,963,715 A 10/1999 Shu et al.
6,020,868 A 2/2000 Greene et al.
6,031,626 A 2/2000 Shu et al.
6,046,716 A 4/2000 McKnight
6,078,303 A 6/2000 McKnight
6,100,861 A 8/2000 Cohen et al.
6,104,367 A 8/2000 McKnight
6,144,353 A 11/2000 McKnight
6,188,385 B1 2/2001 Hill et al.
6,219,025 B1 4/2001 Hill et al.
6,225,973 B1 5/2001 Hill et al.
6,225,991 B1 5/2001 McKnight
6,226,017 B1 5/2001 Goossen et al.
6,236,390 B1 5/2001 Hitchcock
6,239,783 B1 5/2001 Hill et al.
6,243,070 B1 6/2001 Hill et al.
6,257,727 B1 * 7/2001 Melville ..... 353/28
6,278,434 B1 8/2001 Hill et al.
6,281,867 B2 8/2001 Kurematsu et al.
6,281,875 B1 * 8/2001 Zhao et al. ..... 345/611
6,282,327 B1 8/2001 Betrisey et al.
6,304,239 B1 10/2001 McKnight
6,307,566 B1 10/2001 Hill et al.
6,329,971 B2 12/2001 McKnight
6,339,426 B1 1/2002 Lui et al.
6,342,890 B1 1/2002 Shetter
6,342,896 B1 1/2002 Shetter et al.
6,356,278 B1 3/2002 Stamm et al.
6,360,023 B1 3/2002 Betrisey et al.
6,373,195 B1 4/2002 Whang et al.
6,377,262 B1 4/2002 Hitchcock et al.
6,384,839 B1 5/2002 Paul
6,393,145 B2 5/2002 Betrisey et al.
2002/0008713 A1 1/2002 Toji et al.
2002/0008714 A1 1/2002 Tezuka et al.

* cited by examiner

| | | | | | | | | | |
|---|---|---|---|---|---|---|---|---|---|
| $VP_{11}$ | $VP_{12}$ | $VP_{13}$ | $VP_{14}$ | $VP_{15}$ | $VP_{16}$ | $VP_{17}$ | $VP_{18}$ | $VP_{19}$ | $VP_{1(10)}$ |
| $VP_{21}$ | $VP_{22}$ | $VP_{23}$ | $VP_{24}$ | $VP_{25}$ | $VP_{26}$ | $VP_{27}$ | $VP_{28}$ | $VP_{29}$ | $VP_{2(10)}$ |
| $VP_{31}$ | $VP_{32}$ | $VP_{33}$ | ∘ | ∘ | ∘ | ∘ | ∘ | ∘ | ∘ |
| ∘ | ∘ | ∘ | ∘ | ∘ | ∘ | ∘ | ∘ | ∘ | ∘ |
| ∘ | ∘ | ∘ | ∘ | ∘ | ∘ | ∘ | ∘ | ∘ | ∘ |
| $VP_{61}$ | $VP_{62}$ | ∘ | ∘ | ∘ | ∘ | ∘ | ∘ | ∘ | $VP_{6(10)}$ |

METHOD OF FAST PROCESSING IMAGE DATA FOR IMPROVING VISIBILITY OF IMAGE

CLAIM OF PRIORITY

This application makes reference to, incorporates the same herein, and claims all benefits accruing under 35 U.S.C. §119 from an application for METHOD OF FAST PROCESSING IMAGE DATA FOR IMPROVING REPRODUCIBILITY OF IMAGE earlier filed in the Korean Industrial Property Office on 4 Nov. 2002 and there duly assigned Serial No. 2002-67967.

BACKGROUND OF THE INVENTION

1. Field of the Invention

The present invention relates to a method of processing image data, and more particularly, to a method of processing input image data to generate output image data for driving a display panel.

2. Description of the Related Art

A general method of processing image data includes a first virtual screen, which is divided into a plurality of pixel areas according to the resolution of input image data, and a second virtual screen having a sub-pixel array of a display panel. The second virtual screen includes red sub-pixel areas, green sub-pixel areas, and blue sub-pixel areas.

Input image data has only position information of a unit pixel but does not have position information of sub-pixels, i.e., a red sub-pixel, a green sub-pixel, and a blue sub-pixel, constituting the unit pixel. However, the positions of sub-pixels are different in different pixel areas in any display panel. Moreover, for two adjacent pixels, a distance between red sub-pixels, a distance between green sub-pixels, and a distance between blue sub-pixels are different from one another. Accordingly, visibility of images displayed on display panels is degraded.

A technique related to the visibility of an image is disclosed in U.S. Pat. No. 5,341,153 for Method and Apparatus for Displaying a Multicolor Image by Benzschawel et al. According to this technique, input image data having a high resolution is directly superimposed on a display panel having a low resolution. This technique cannot radically solve the image visibility problem of a display panel due to a sub-pixel array structure. Moreover, since an input image data transforming operation is individually performed for all of the sub-pixels of a display panel, display speed decreases.

SUMMARY OF THE INVENTION

It is therefore an object of the present invention to provide a method of processing image data which fundamentally solves the problem of image visibility due to the sub-pixel array structure of a display panel with the minimum number of input image data transforming operations.

It is another object to process image data by providing a new resolution for input image data that is set in order to maximize the number of masks having the same area ratio structures and accordingly, the number of masks to be used is minimized, so the number of times area ratios are multiplied by transformed image data is minimized, thereby increasing display speed and decreasing necessary memory-capacity.

It is yet another object to process image data by having each sub-pixel of a display panel be involved with the data of its adjacent pixels on a first virtual screen, so a problem in reproducing an image due to the sub-pixel array structure of the display panel can be radically solved.

It is still another object to correct a color error, which may occur during data processing.

In order to accomplish the above and other objects, accordingly to an aspect of the present invention, there is provided a method of processing image data to generate output image data for driving a display panel. In the method, a new resolution for input image data is set according to a resolution of the display panel. A first virtual screen is divided into a plurality of pixel areas according to the new resolution set for the input image data. A second virtual screen having a sub-pixel array structure of the display panel is superimposed on the first virtual screen. A mask wider than a sub-pixel area on the superimposed second virtual screen is laid on each sub-pixel area. An area ratio of the area of each pixel portion on the first virtual screen included in each mask to the area of the mask is obtained and set. The new resolution and the area ratios are applied to a driving device of the display panel. The input image data having an original resolution is transformed into image data having the new and enhanced resolution. The sum of the results of multiplying an area ratio of the area of each pixel portion on the first virtual screen included in each mask by the transformed image data of the pixel areas, respectively, is generated as output image data of a sub-pixel corresponding to the mask.

The method of processing image data according to the present invention has the following effects.

First, a new resolution for input image data can be set in order to maximize the number of masks having the same area ratio structures. Accordingly, the number of masks to be used is minimized, so the number of times area ratios are multiplied by transformed image data is minimized, thereby increasing display speed and decreasing necessary memory-capacity.

Second, each sub-pixel of a display panel is involved with the data of its adjacent pixels on a first virtual screen, so a problem in reproducing an image due to the sub-pixel array structure of the display panel can be radically solved.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
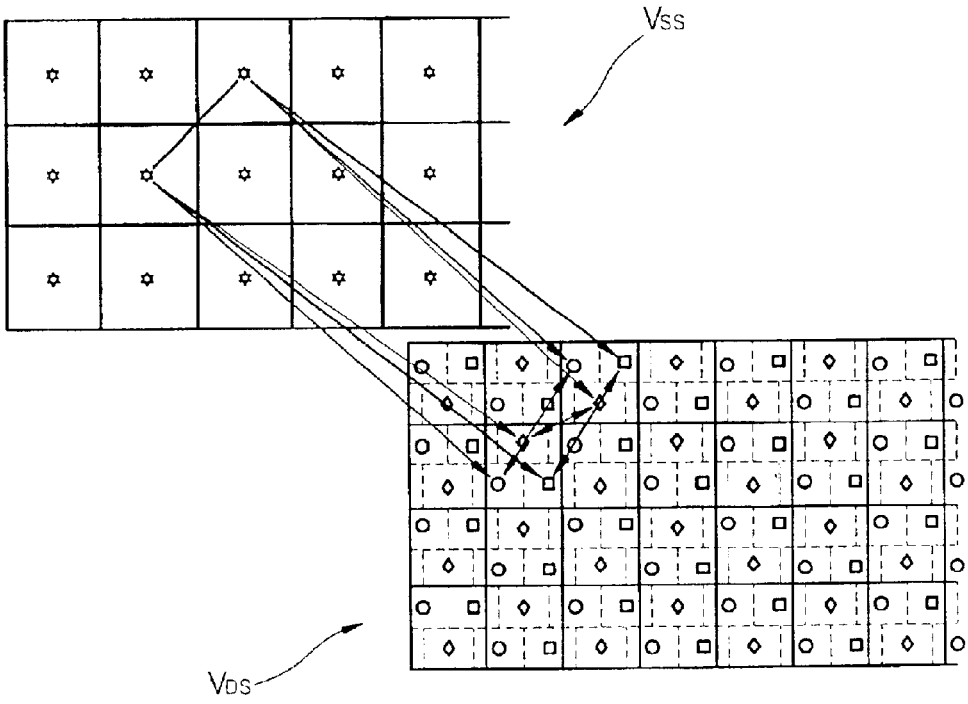
FIG. 1 shows the principle of a conventional method of processing image data.

FIG. 1 shows the principle of a general method of processing image data. A reference character $V_{SS}$ denotes a first virtual screen, which is divided into a plurality of pixel areas according to the resolution of input image data. A reference character $V_{DS}$ denotes a second virtual screen having a sub-pixel array of a display panel. On the second virtual screen $V_{DS}$, areas having a circle at their center are red sub-pixel areas, areas having a square at their center are green sub-pixel areas, and areas having a diamond at their center are blue sub-pixel areas.

Referring to FIG. 1, input image data has only position information of a unit pixel but does not have position information of sub-pixels, i.e., a red sub-pixel, a green sub-pixel, and a blue sub-pixel, constituting the unit pixel. However, the positions of sub-pixels are different in different pixel areas in any display panel. Moreover, for two adjacent pixels, a distance between red sub-pixels, a distance between green sub-pixels, and a distance between blue sub-pixels are different from one another. Accordingly, visibility of images displayed on display panels is degraded.

Figure 2:
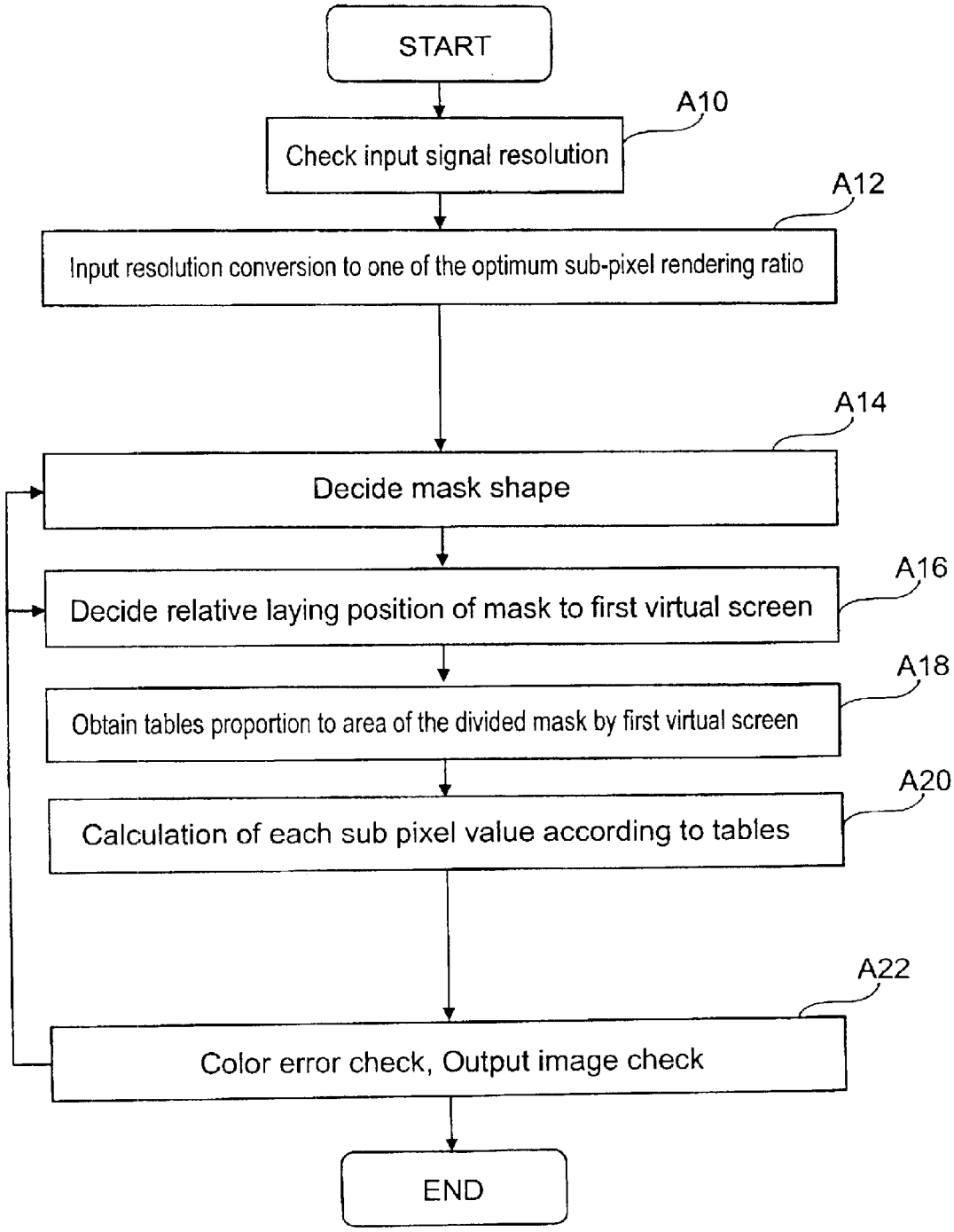
FIG. 2 is a diagram for sub-pixel rendering methodology.

Referring to the diagram of FIG. 2, sub-pixel rendering methodology includes checking input signal resolution (step A10). After checking the input signal resolution, the input resolution conversion is made to one of the optimum sub-pixel rendering ratios (step A12). After step A12, the mask shape is decided (step A14). The relative laying position of the mask to the first virtual screen is also decided (step A16). Tables proportionate to the area of the divided mask by the first virtual screen are obtained (step A18). The sub pixel values are calculated according to the tables (step A20). Finally, the color checked for any errors and the output image is checked (step A22).

Figure 3:
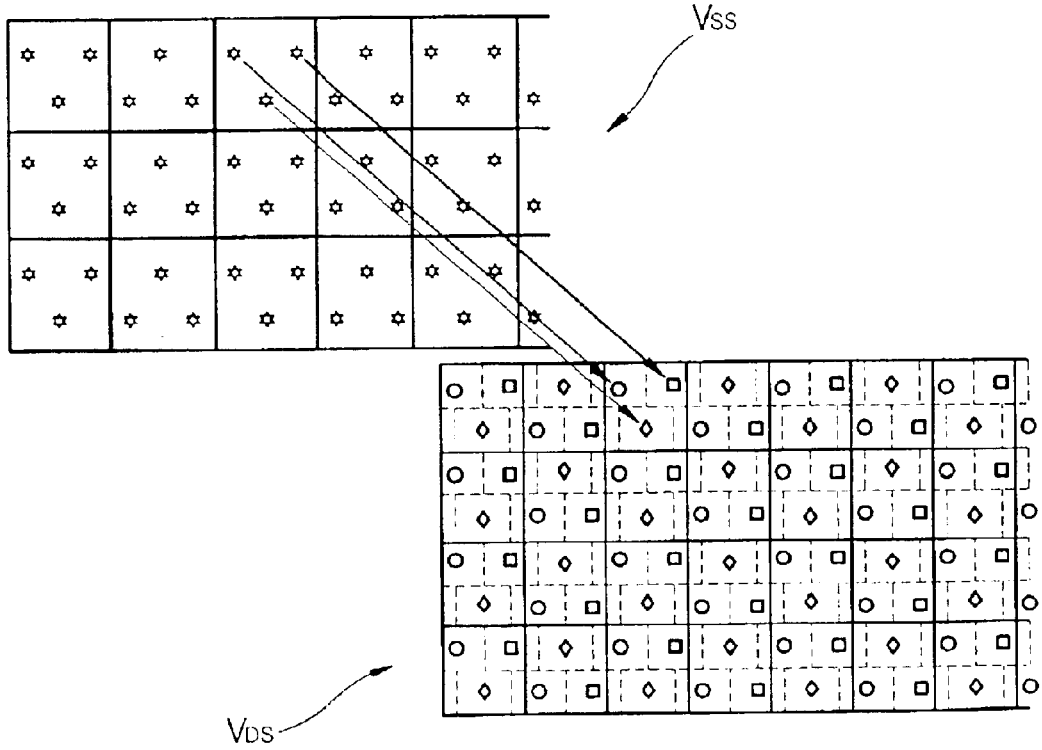
FIG. 3 shows the principle of a method of processing image data according to the present invention.

FIG. 3 shows the principle of a method of processing image data according to the present invention. A reference character $V_{SS}$ denotes a first virtual screen, which is divided into a plurality of pixel areas according to a new resolution of input image data. A reference character $V_{DS}$ denotes a second virtual screen having a sub-pixel array of a display panel. On the second virtual screen $V_{DS}$, areas having a circle at their center are red sub-pixel areas, areas having a square at their center are green sub-pixel areas, and areas having a diamond at their center are blue sub-pixel areas.

Figure 4:
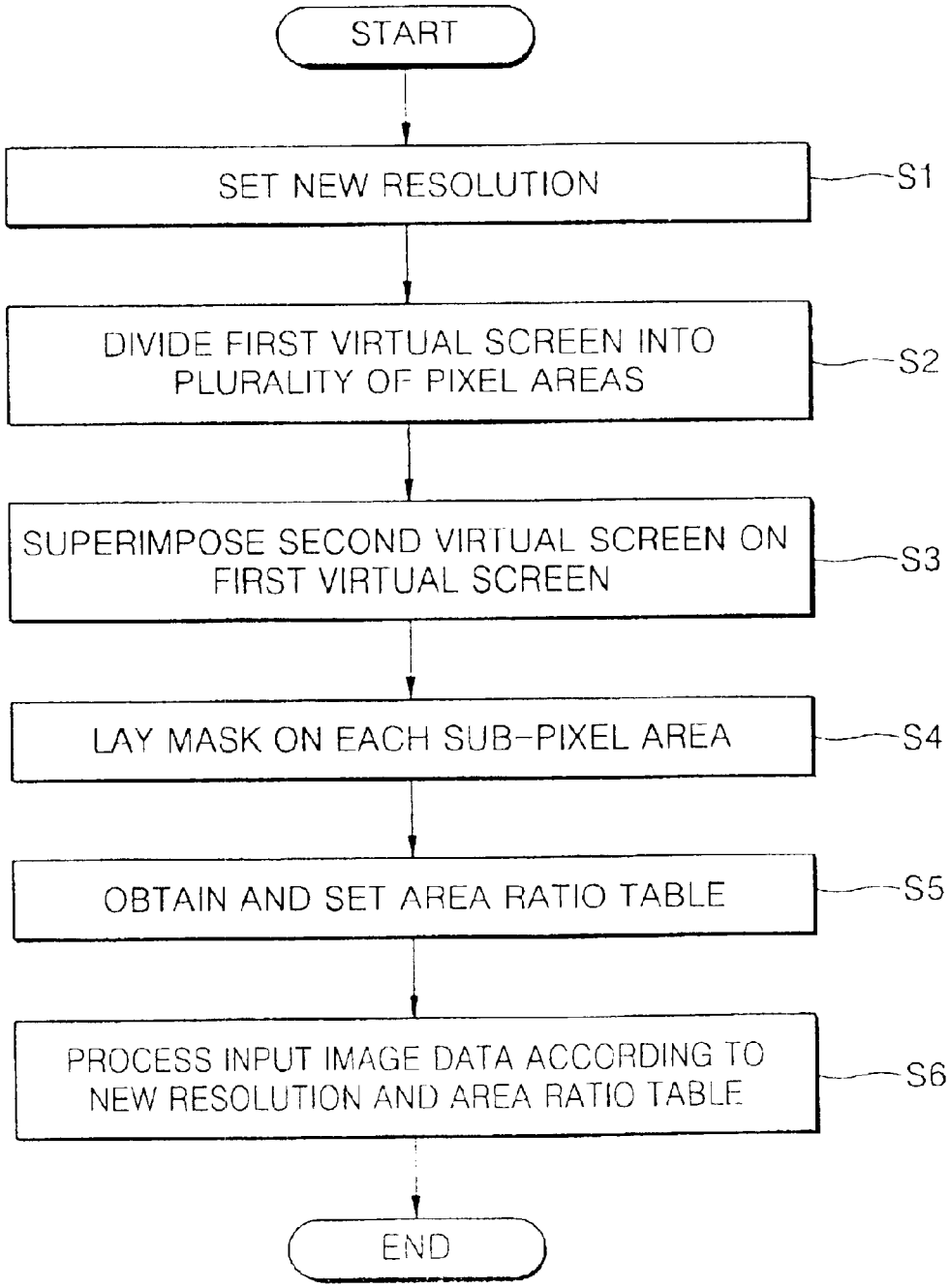
FIG. 4 is a flowchart of a method of processing image data according to an embodiment of the present invention.

FIG. 4 shows a method of processing image data according to an embodiment of the present invention. In FIG. 4, steps S1 through S5 indicate steps of setting a resolution and an area ratio during manufacture of a display driving device. The method of processing image data according to an embodiment of the present invention will be schematically described with reference to FIGS. 3 and 4.

A new resolution for input image data is set according to the resolution of a display panel in step S1. Here, a new horizontal resolution and a new vertical resolution are set. The new horizontal resolution for the input image data is set according to the horizontal resolution of the display panel, and the new vertical resolution for the input image data is set according to the vertical resolution of the display panel.

The first virtual screen $V_{SS}$ is divided into a plurality of pixel areas according to the new resolution of the input image data in step S2. The second virtual screen $V_{DS}$ having the sub-pixel array structure of a display panel is superimposed on the first virtual screen $V_{SS}$ in step S3. A mask, which is wider than each sub-pixel area of the display panel on the superimposition of the virtual screens $V_{DS}$–$V_{SS}$, is laid on each cell area of the display panel in step S4. It is also preferable that the mask does not include the next same color sub-pixel. For example, if the mask includes a first color sub-pixel, then the mask should not touch or include the next sub-pixel having also the first color. As another example, the mask may include only one of each sub-pixel color. An area ratio table showing the ratio of the area of each pixel portion of the first virtual screen $V_{SS}$ in each mask to the area of the mask, is obtained and set in step S5. In step S6, the resolution set in step S1 and the area ratio table set in step S5 are applied to a driving device of the display panel, the input image data is transformed so that the original resolution of the input image data is changed into the new resolution set in step S1, and then the sum of the results of multiplying the ratio of the area of each pixel portion included in each mask to the area of the mask by the transformed image data is generated as output image data of a sub-pixel corresponding to the mask. In other words, each sub-pixel of the display panel is involved with the data of its adjacent pixels on the first virtual screen $V_{SS}$. Accordingly, as shown in FIG. 3, the input image data of the first virtual screen $V_{SS}$ can be corrected to be suitable to the sub-pixel array structure of the display panel, thereby radically solving a problem in image visibility due to the sub-pixel array structure of the display panel.

In addition, in step S1 the new resolution for the input image data is set to maximize the number of masks having the same area ratio structures in step S5, so the number of masks used in step S4 is minimized. Consequently, the number of times the area ratios are multiplied by the transformed image data is minimized.

Figure 5:
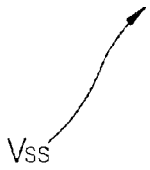
FIG. 5 shows an example of a first virtual screen resulting from step S2 shown in FIG. 4.

Referring to FIG. 5, when step S2 shown in FIG. 4 is performed, the first virtual screen $V_{SS}$ is divided into a plurality of pixel areas $VP_{11}$ through $VP_{6(10)}$ according to the new resolution set for the input image data.

Figure 6:
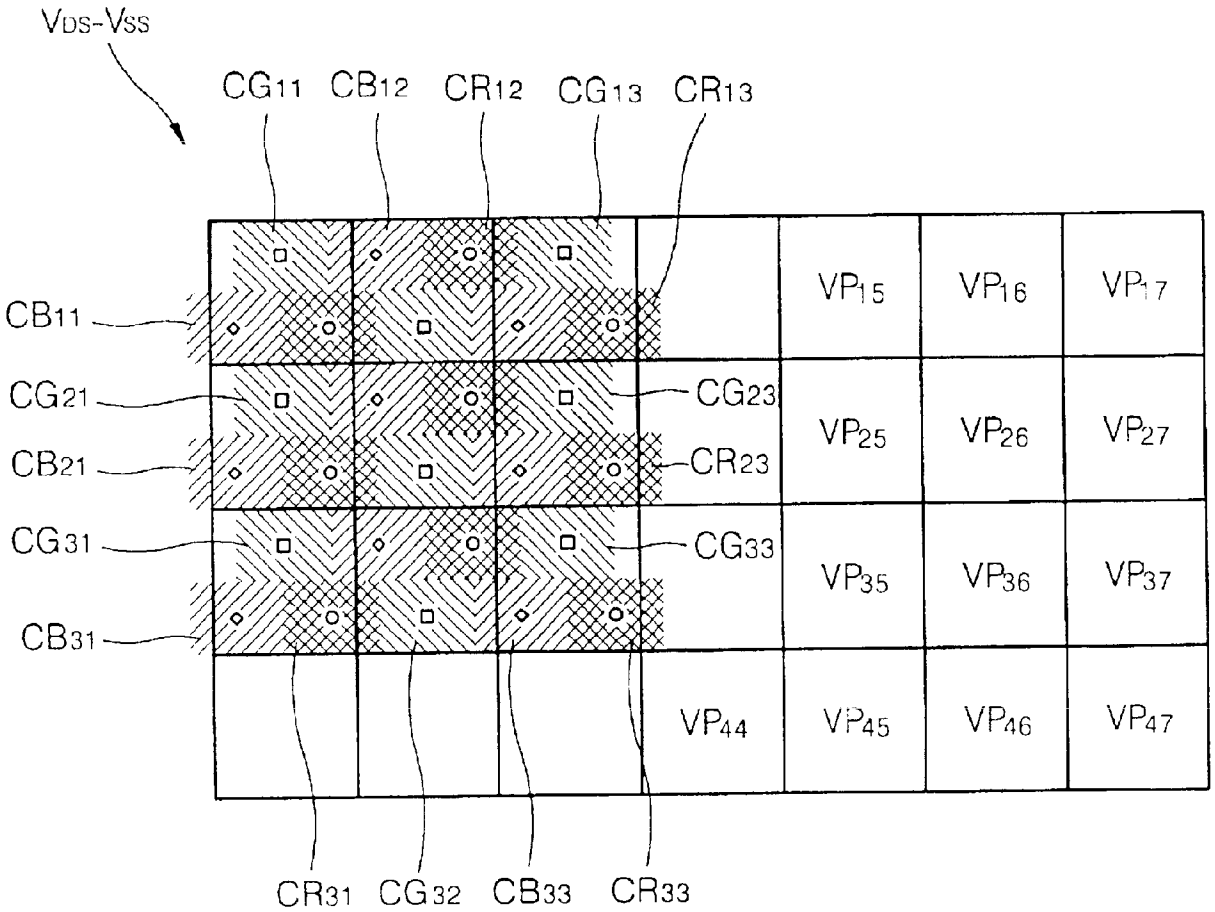
FIG. 6 shows an example of the superimposition of virtual screens resulting from step S3 shown in FIG. 4 when a ratio of a new resolution of input image data to the resolution of a display panel is 1:1.

FIG. 6 shows an example of the superimposition of the virtual screens $V_{DS}$–$V_{SS}$ resulting from step S3 shown in FIG. 4 when a ratio of the new resolution of the input image data to the resolution of the display panel is 1:1. In FIG. 6, reference characters $CR_{12}$ through $CR_{33}$ denote red sub-pixel areas, reference characters $CG_{11}$ through $CG_{33}$ denote green sub-pixel areas, and reference characters $CB_{11}$ through $CB_{33}$ denote blue sub-pixel areas. Referring to FIG. 6, the second virtual screen $V_{DS}$ having a delta structure as the sub-pixel array structure of the display panel is superimposed on the first virtual screen $V_{SS}$. In other words, the second virtual screen $V_{DS}$ divided into plurality of sub-pixel areas $CG_{11}$ through $CR_{33}$ is superimposed on the first virtual screen $V_{SS}$ divided into a plurality of pixel areas $VP_{15}$ through $VP_{47}$.

Figure 7:
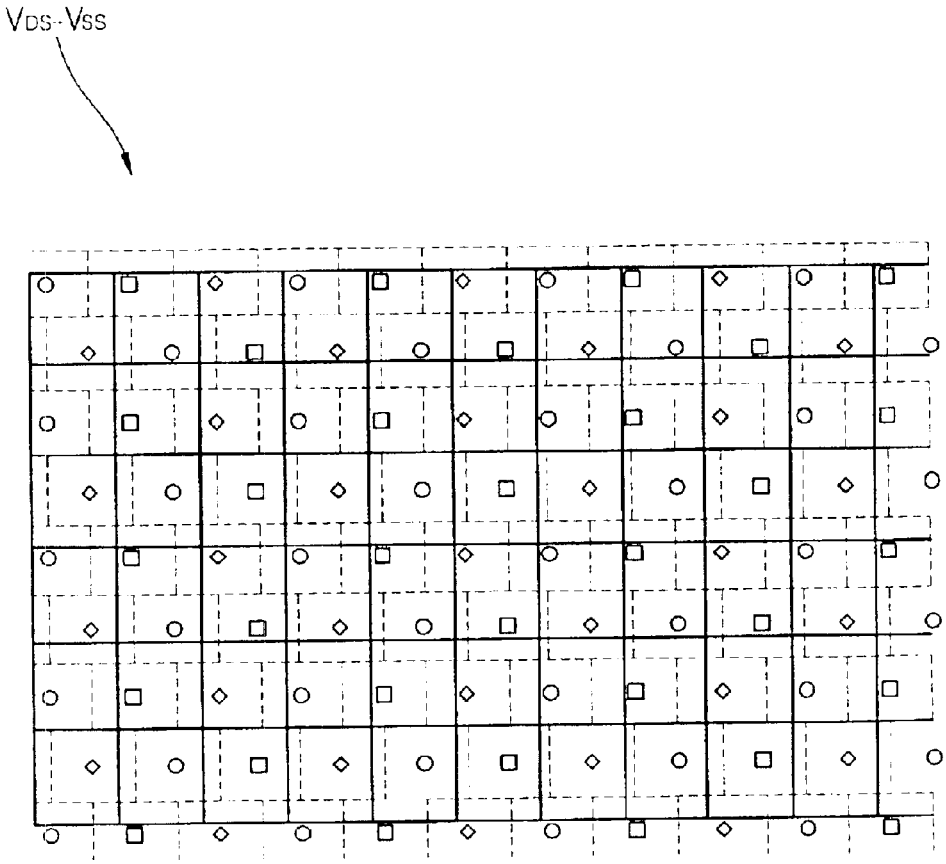
FIG. 7 shows an example of the superimposition of virtual screens resulting from step S3 shown in FIG. 4 when a ratio of a new resolution of input image data to the resolution of a display panel is 1.5:1.

FIG. 7 shows an example of the superimposition of the virtual screens $V_{DS}$–$V_{SS}$ resulting from step S3 shown in FIG. 4 when a ratio of the new resolution of the input image data to the resolution of the display panel is 1.5:1. In FIG. 7, areas defined by solid lines are pixel areas on the first virtual screen $V_{SS}$, and areas defined by dotted lines are sub-pixel areas on the second virtual screen $V_{DS}$. On the second virtual screen $V_{DS}$, areas having a circle at their center are red sub-pixel areas, areas having a square at their center are green sub-pixel areas, and areas having a diamond at their center are blue sub-pixel areas.

Figure 8A:
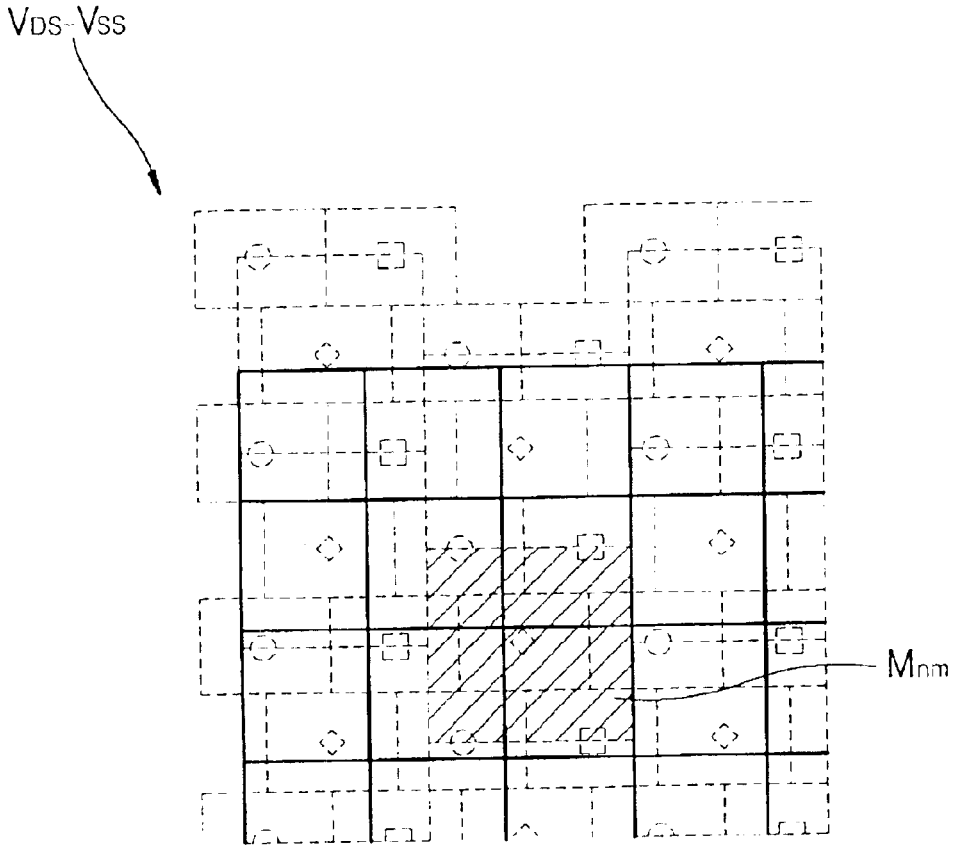
FIG. 8A shows an example of the superimposition of virtual screens on which a quadrilateral mask is laid on each blue sub-pixel area as the result of performing step S4 shown in FIG. 4 when a ratio of a new resolution of input image data to the resolution of a display panel is 1.5:1.
Figure 8B:
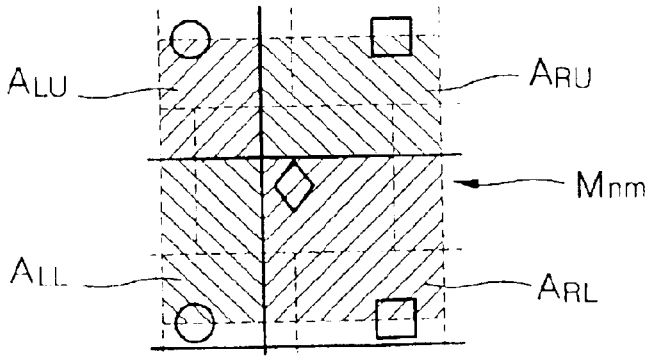
FIG. 8B shows an enlarged view of a hatched mask area shown in FIG. 8A in order to explain an algorithm used in step S5 shown in FIG. 4.

FIG. 8A shows an example of the superimposition of the virtual screens $V_{DS}$–$V_{SS}$ on which a quadrilateral mask is laid on each blue sub-pixel area as the result of performing step S4 shown in FIG. 4 when a ratio of the new resolution of the input image data to the resolution of the display panel is 1.5:1. After step S4 shown in FIG. 4 is performed, step S5 shown in FIG. 4 is performed. In other words, for each mask, the ratio of the area of each pixel portion of the first virtual screen $V_{SS}$ included in the mask to the area of the mask is obtained and set. FIG. 8B shows an enlarged view of a hatched mask $M_{nm}$ shown in FIG. 8A in order to explain an algorithm used in step S5 shown in FIG. 4. The mask $M_{nm}$ is for a blue sub-pixel at an n-th place in a horizontal direction and an m-th place in a vertical direction. In FIG. 8B, a reference character $A_{LU}$ denotes the area of an upper left pixel portion, a reference character $A_{RU}$ denotes the area of an upper right pixel portion, a reference character $A_{LL}$ denotes the area of a lower left pixel portion, and a reference character $A_{RL}$ denotes the area of a lower right pixel portion. Accordingly, an area ratio of the area of each pixel portion of the first virtual screen $V_{SS}$ included in the blue sub-pixel mask $M_{nm}$ to the area of the blue sub-pixel mask $M_{nm}$ is obtained using the areas $A_{LU}$, $A_{RU}$, $A_{LL}$, and $A_{RL}$ and a unit mask area $A_{LU}+A_{RU}+A_{LL}+A_{RL}$. In step S6, output image data $b_{mn}$ for the blue sub-pixel shown in FIG. 8B is obtained using $$b_{mn} = \frac{A_{LU} \cdot b_{LU} + A_{RU} \cdot b_{RU} + A_{LL} \cdot b_{LL} + A_{RL} \cdot b_{RL}}{A_{LU} + A_{RU} + A_{LL} + A_{RL}} \quad (1)$$

In Formula (1), $b_{LU}$ indicates blue image data of a pixel area including the area $A_{LU}$ on the first virtual screen $V_{SS}$, $b_{RU}$ indicates blue image data of a pixel area including the area $A_{RU}$ on the first virtual screen $V_{SS}$, $b_{LL}$ indicates blue image data of a pixel area including the area $A_{LL}$ on the first virtual screen $V_{SS}$, and $b_{RL}$ indicates blue image data of a pixel area including the area $A_{RL}$ on the first virtual screen $V_{SS}$.

Accordingly, the input image data of the first virtual screen $V_{SS}$ can be corrected to be suitable to the sub-pixel array structure of the display panel, thereby radically solving a problem in image visibility due to the sub-pixel array structure of the display panel.

Figure 9A:
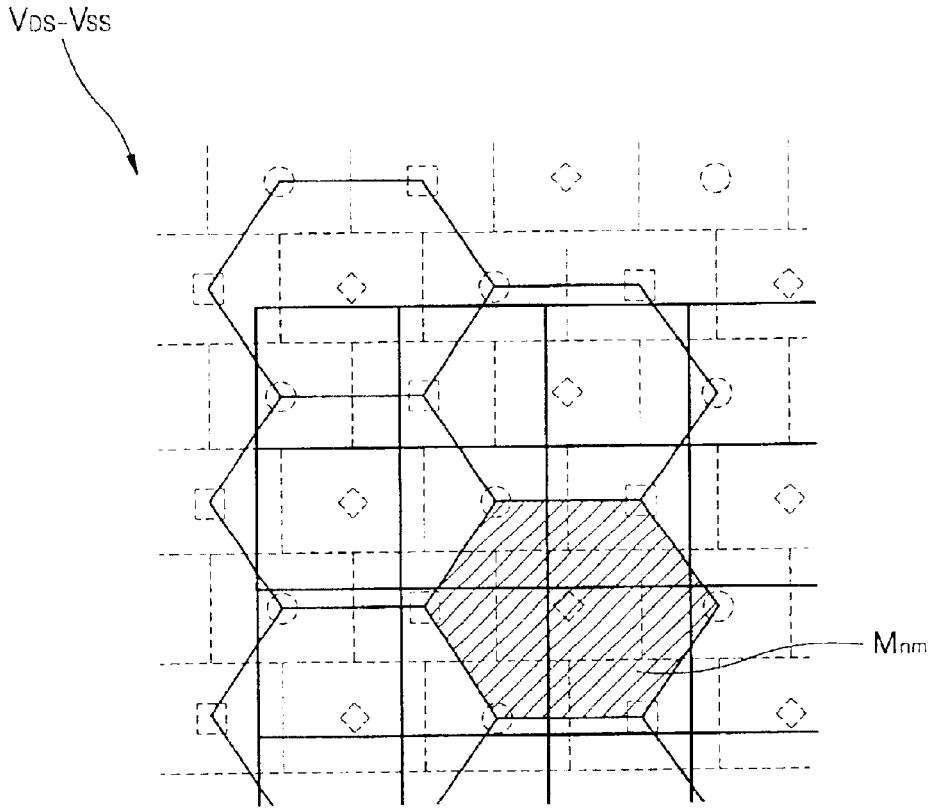
FIG. 9A shows an example of the superimposition of virtual screens on which a hexagonal mask is laid on each blue sub-pixel area as the result of performing step S4 shown in FIG. 4 when a ratio of a new resolution of input image data to the resolution of a display panel is 1.5:1.
Figure 9B:
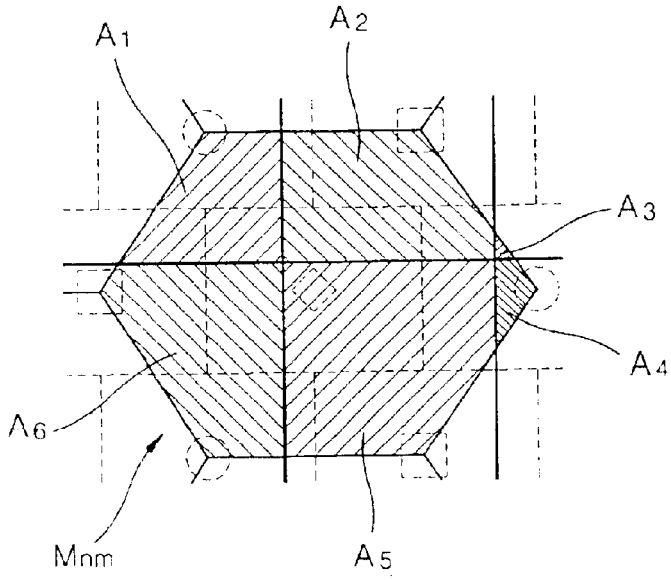
FIG. 9B shows an enlarged view of a hatched mask area shown in FIG. 9A in order to explain another algorithm used in step S5 shown in FIG. 4.

FIG. 9A shows an example of the superimposition of the virtual screens $V_{DS}$–$V_{SS}$ on which a hexagonal mask is laid on each blue sub-pixel area as the result of performing step S4 shown in FIG. 4 when a ratio of the new resolution of the input image data to the resolution of the display panel is 1.5:1. After step S4 shown in FIG. 4 is performed, step S5 shown in FIG. 4 is performed. In other words, for each mask, the ratio of the area of each pixel portion of the first virtual screen $V_{SS}$ included in the mask to the area of the mask is obtained and set. FIG. 9B shows an enlarged view of a hatched mask $M_{nm}$ shown in FIG. 9A in order to explain another algorithm used in step S5 shown in FIG. 4. The mask $M_{nm}$ is for a blue sub-pixel at an n-th place in a horizontal direction and an m-th place in a vertical direction. In FIG. 9B, a reference character $A_1$ denotes the area of a first pixel portion, a reference character $A_2$ denotes the area of a second pixel portion, a reference character $A_3$ denotes the area of a third pixel portion, a reference character $A_4$ denotes the area of a fourth pixel portion, a reference character $A_5$ denotes the area of a fifth pixel portion, and a reference character $A_6$ denotes the area of a sixth pixel portion. Accordingly, an area ratio of the area of each pixel portion of the first virtual screen $V_{SS}$ included in the blue sub-pixel mask $M_{nm}$ to the area of the blue sub-pixel mask $M_{nm}$ is obtained using the areas $A_1$, $A_2$, $A_3$, $A_4$, $A_5$, and $A_6$ and a unit mask area $A_1+A_2+A_3+A_4+A_5+A_6$. In step S6, output image data $b_{mn}$ for the blue sub-pixel shown in FIG. 9B is obtained using Formula (2).

$$b_{mn} = \frac{A_1 \cdot b_1 + A_2 \cdot b_2 + A_3 \cdot b_3 + A_4 \cdot b_4 + A_5 \cdot b_5 + A_6 \cdot b_6}{A_1 + A_2 + A_3 + A_4 + A_5 + A_6} \quad (2)$$

In Formula (2), $b_1$ indicates blue image data of a pixel area including the area $A_1$ on the first virtual screen $V_{SS}$, $b_2$ indicates blue image data of a pixel area including the area $A_2$ on the first virtual screen $V_{SS}$, $b_3$ indicates blue image data of a pixel area including the area $A_3$ on the first virtual screen $V_{SS}$, $b_4$ indicates blue image data of a pixel area including the area $A_4$ on the first virtual screen $V_{SS}$, $b_5$ indicates blue image data of a pixel area including the area $A_5$ on the first virtual screen $V_{SS}$, and $b_6$ indicates blue image data of a pixel area including the area $A_6$ on the first virtual screen $V_{SS}$.

Accordingly, the input image data of the first virtual screen $V_{SS}$ can be corrected to be suitable to the sub-pixel array structure of the display panel, thereby radically solving a problem in image visibility due to the sub-pixel array structure of the display panel.

Stated in another way, formula 2 can be shown with the output image data $b_{mn}$ for the blue sub-pixel shown in FIG. 9B being obtained using Formula (3).

$$b_{mn} = \frac{\sum_{y=1}^{z} A_y \cdot b_y}{\sum_{y=1}^{z} A_y} \tag{3}$$

In Formula (3), "A" indicates an area of a portion of the mask, z is the number of portions of the mask, and b is the image data of a pixel area including the area A on the first virtual screen. Therefore, y is an integer from 1 to the total number of portions z of the mask.

Figure 10A:
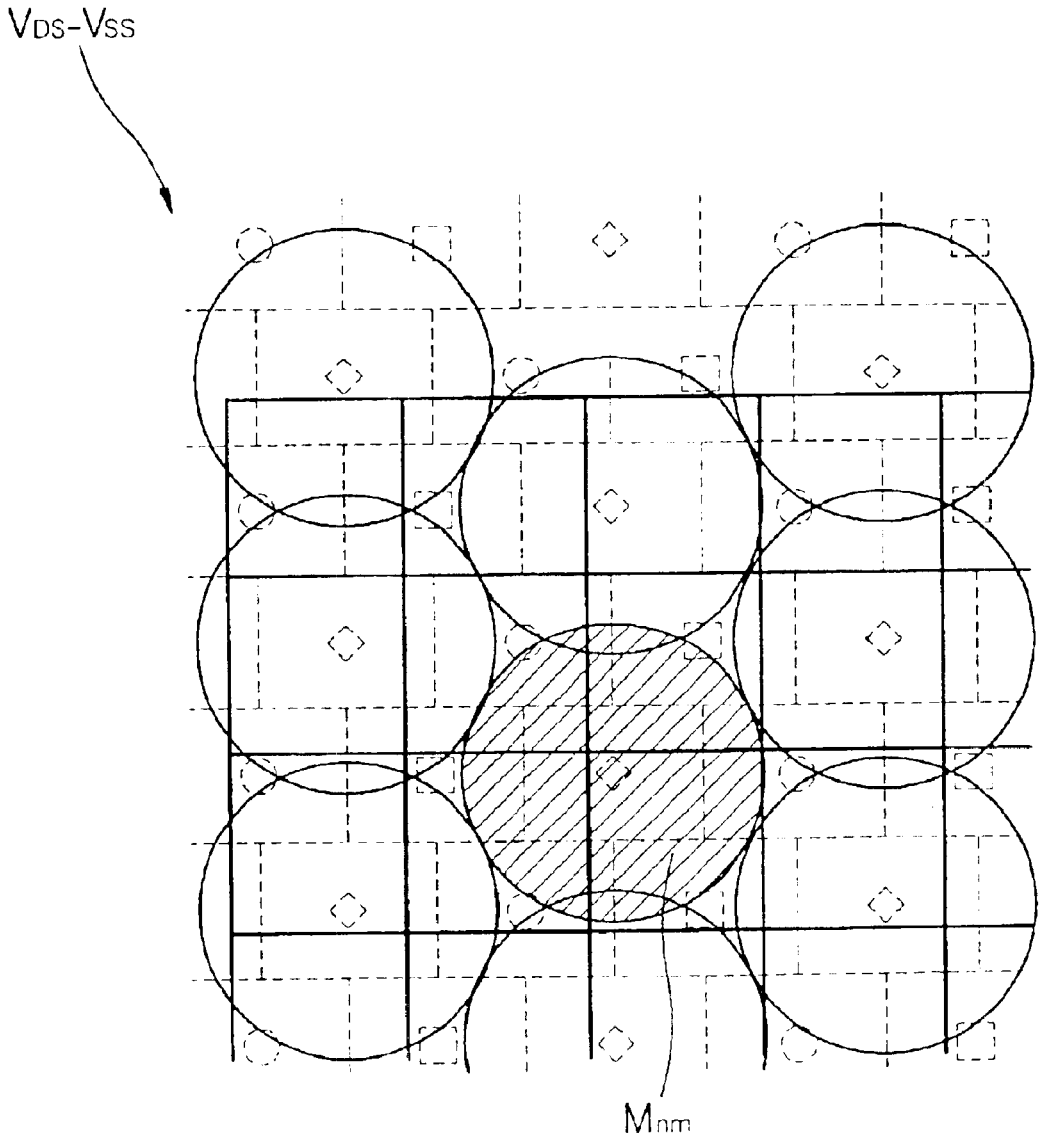
FIG. 10A shows an example of the superimposition of virtual screens on which a circular mask is laid on each blue sub-pixel area as the result of performing step S4 shown in FIG. 4 when a ratio of a new resolution of input image data to the resolution of a display panel is 1.5:1.
Figure 10B:
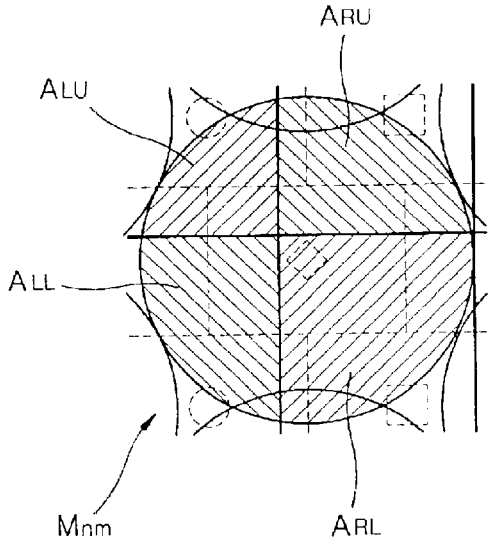
FIG. 10B shows an enlarged view of a hatched mask area shown in FIG. 10A in order to explain still another algorithm used in step S5 shown in FIG. 4.

FIG. 10A shows an example of the superimposition of the virtual screens $V_{DS}$–$V_{SS}$ on which a circular mask is laid on each blue sub-pixel area as the result of performing step S4 shown in FIG. 4 when a ratio of the new resolution of the input image data to the resolution of the display panel is 1.5:1. FIG. 10B shows an enlarged view of a hatched mask $M_{nm}$ shown in FIG. 10A in order to explain an algorithm used in step S5 shown in FIG. 4. The mask $M_{nm}$ is for a blue sub-pixel at an n-th place in a horizontal direction and an m-th place in a vertical direction. In FIG. 10B, a reference character $A_{LU}$ denotes the area of an upper left pixel portion, a reference character $A_{RU}$ denotes the area of an upper right pixel portion, a reference character $A_{LL}$ denotes the area of a lower left pixel portion, and a reference character $A_{RL}$ denotes the area of a lower right pixel portion. The description of FIGS. 10A and 10B is the same as that of FIGS. 8A and 8B, and is thus omitted. Meanwhile, circular masks are ideal in theory, but in practice some pixel areas are used twice and some pixel areas are not used at all in obtaining output image data. Accordingly, circular masks are less preferable than quadrilateral and hexagonal masks. However, it is preferable that the shape of masks is the same as the shape of sub-pixels of a display panel.

Figure 11:
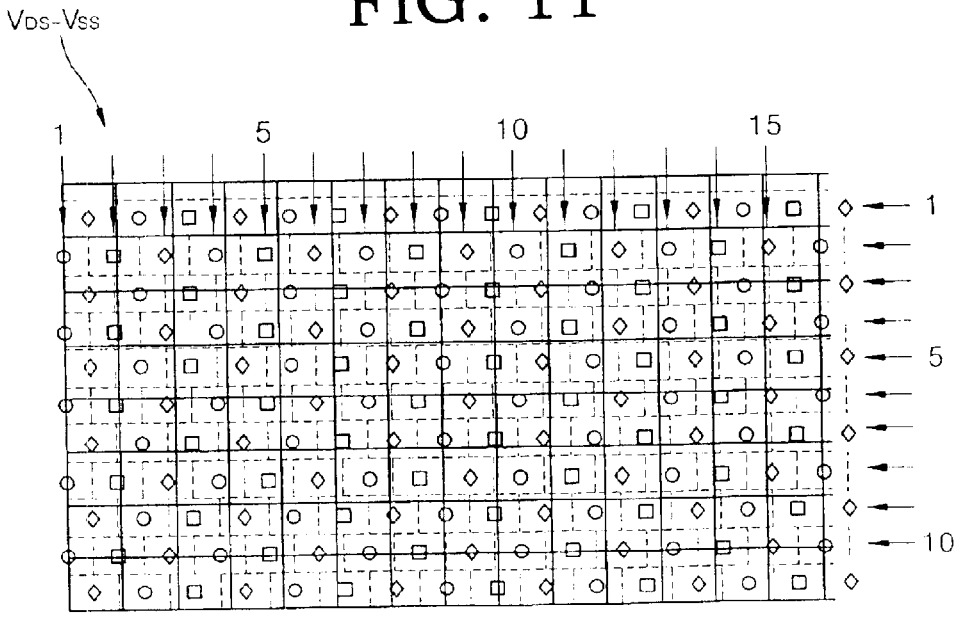
FIG. 11 shows sub-pixel areas on a second virtual screen, which are disposed at different horizontal and vertical positions with respect to unit pixel areas on a first virtual screen when a ratio of a new resolution of input image data to the resolution of a display panel is 1.4:1.

FIG. 11 shows sub-pixel areas on the second virtual screen $V_{DS}$, which are disposed at different horizontal and vertical positions with respect to unit pixel areas on the first virtual screen $V_{SS}$ when a ratio of the new resolution of the input image data to the resolution of the display panel is 1.4:1. In FIG. 11, areas defined by solid lines are pixel areas on the first virtual screen $V_{SS}$, and areas defined by dotted lines are sub-pixel areas on the second virtual screen $V_{DS}$. On the second virtual screen $V_{DS}$, areas having a circle at their center are red sub-pixel areas, areas having a square at their center are green sub-pixel areas, and areas having a diamond at their center are blue sub-pixel areas. Referring to FIG. 11, the number of different horizontal positions of sub-pixel areas is 15, and the number of different vertical positions thereof is 10. In other words, 150 masks must be used in step S4 shown in FIG. 4. Accordingly, in step S6, the number of times, that area ratios are multiplied by transformed image data, relatively increases, thereby decreasing display speed and increasing necessary memory-capacity.

Figure 12:
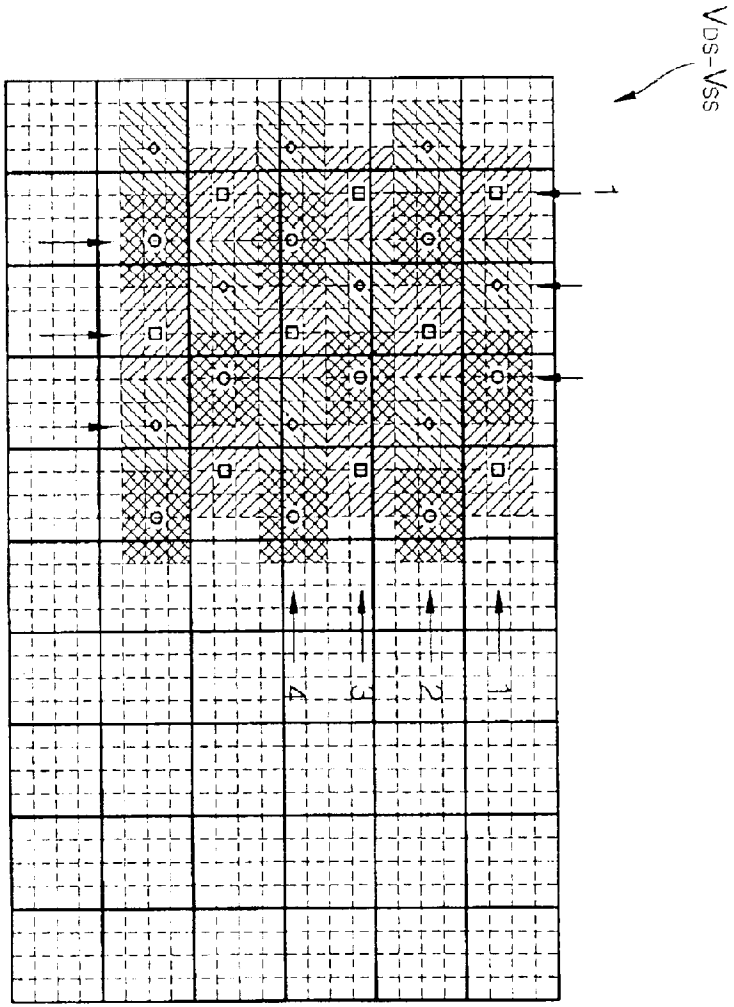
FIG. 12 shows sub-pixel areas on a second virtual screen, which are disposed at different horizontal and vertical positions in different unit pixel areas on a first virtual screen when a ratio of a new resolution of input image data to the resolution of a display panel is 1.5:1.

FIG. 12 shows sub-pixel areas on the second virtual screen $V_{DS}$, which are disposed at different horizontal and vertical positions with respect to unit pixel areas on the first virtual screen $V_{SS}$ when a ratio of the new resolution of the input image data to the resolution of the display panel is 1.5:1. In FIG. 12, areas defined by solid lines are pixel areas on the first virtual screen $V_{SS}$. On the second virtual screen $V_{DS}$, areas having a circle at their center are red sub-pixel areas, areas having a square at their center are green sub-pixel areas, and areas having a diamond at their center are blue sub-pixel areas. Referring to FIG. 12, the number of different horizontal positions of sub-pixel areas is 0, and the number of different vertical positions thereof is 4. In other words, only 4 masks are used in step S4 shown in FIG. 4. Accordingly, in step S6, the number of times area ratios are multiplied by transformed image data decreases, thereby increasing display speed. For example, an area ratio table shown in Table 1 is obtained in step S5 shown in FIG. 4.

TABLE 1

| | Pixel-area positions | | | | | | | |
|---|---|---|---|---|---|---|---|---|
| Masks | 1 | 2 | 3 | 4 | 5 | 6 | 7 | Sums |
| A | 2 | 1 | 16 | 8 | 6 | 3 | | 36 |
| B | 10 | 5 | 14 | 7 | | | | 36 |
| C | 7 | 14 | 5 | 10 | | | | 36 |
| D | 3 | 6 | 8 | 16 | 1 | 2 | | 36 |

Here, the mask shown in FIG. 8B corresponds to the mask C in Table 1. Referring to FIG. 8B and mask C in Table 1, the area $A_{LL}$ has area ratio of 7, the area $A_{RL}$ has area ratio of 14, the area $A_{LU}$ has area ratio of 5, and the area $A_{RU}$ has area ratio of 10.

Therefore, it can be inferred from FIGS. 11 and 12 that the number of masks to be used is minimized by performing step S1 shown in FIG. 4.

Figure 13A:
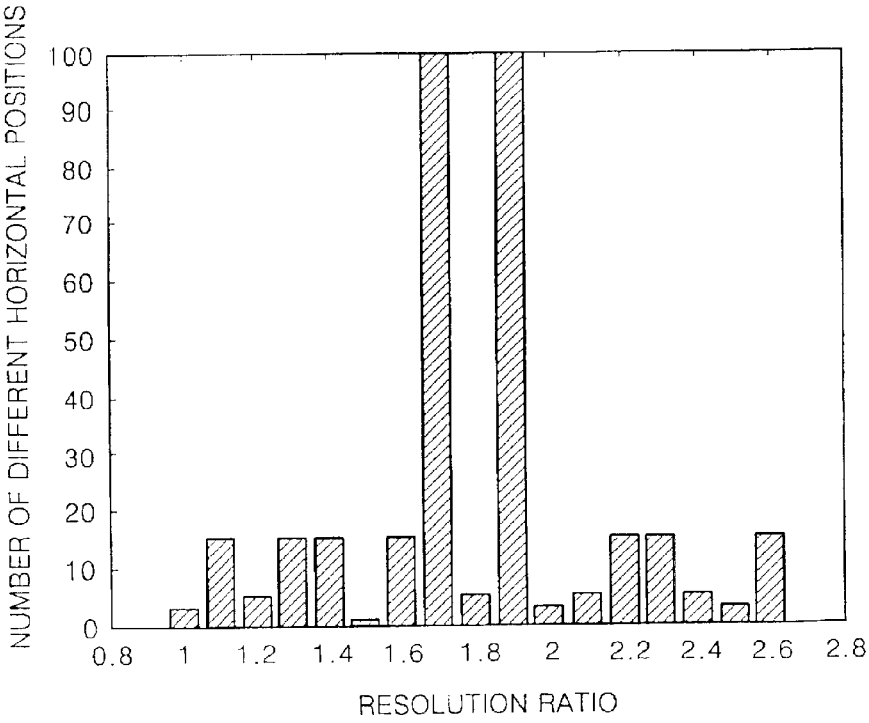
FIG. 13A is a graph of the number of different horizontal positions with respect to a horizontal resolution ratio when the sub-pixel areas of a display panel have a delta structure.

FIG. 13A is a graph of the number of different horizontal positions with respect to a horizontal resolution ratio when the sub-pixel areas of a display panel have a delta structure. Here, the delta structure is a sub-pixel array structure shown in the second virtual screen $V_{DS}$ of FIG. 3. Referring to FIG. 13A, it is preferable to set a new horizontal resolution for input image data such that a ratio of the new horizontal resolution to the horizontal resolution of the display panel is 1:1, 1.5:1, or 2:1.

Figure 13B:
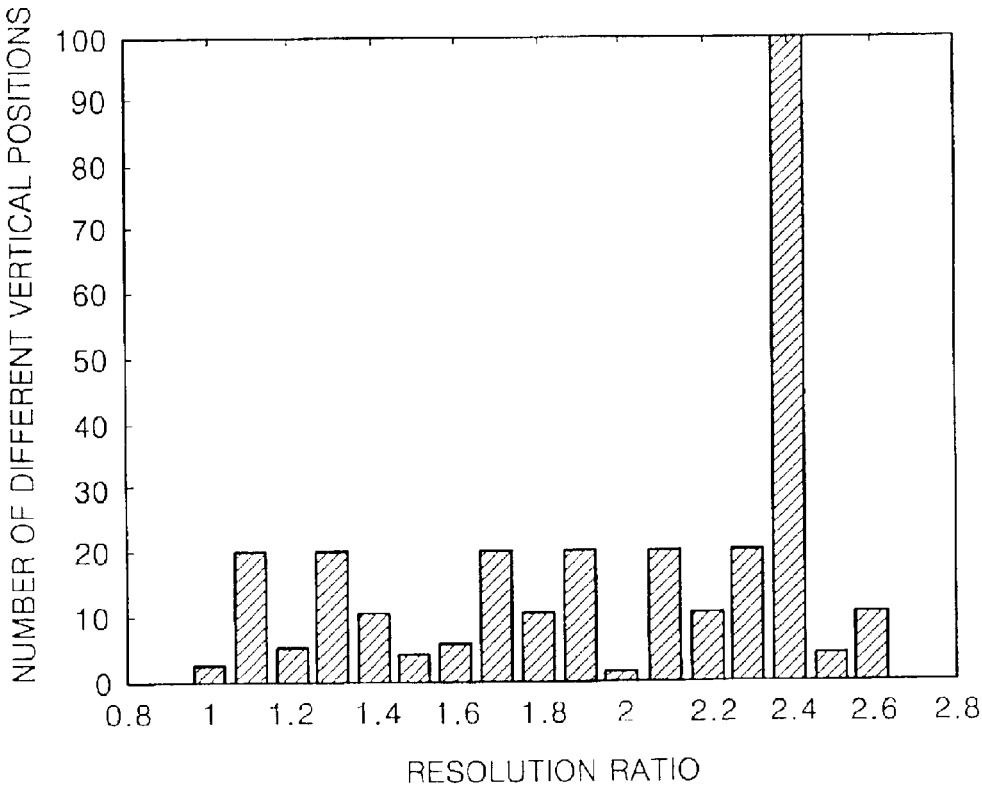
FIG. 13B is a graph of the number of different vertical positions with respect to a vertical resolution ratio when the sub-pixel areas of a display panel have a delta structure.

FIG. 13B is a graph of the number of different vertical positions with respect to a vertical resolution ratio when the sub-pixel areas of a display panel have a delta structure. Referring to FIG. 13B, it is preferable to set a new vertical resolution for input image data such that a ratio of the new vertical resolution to the vertical resolution of the display panel is 1:1, 1.2:1, 1.5:1, 1.6:1, or 2:1.

Figure 14:
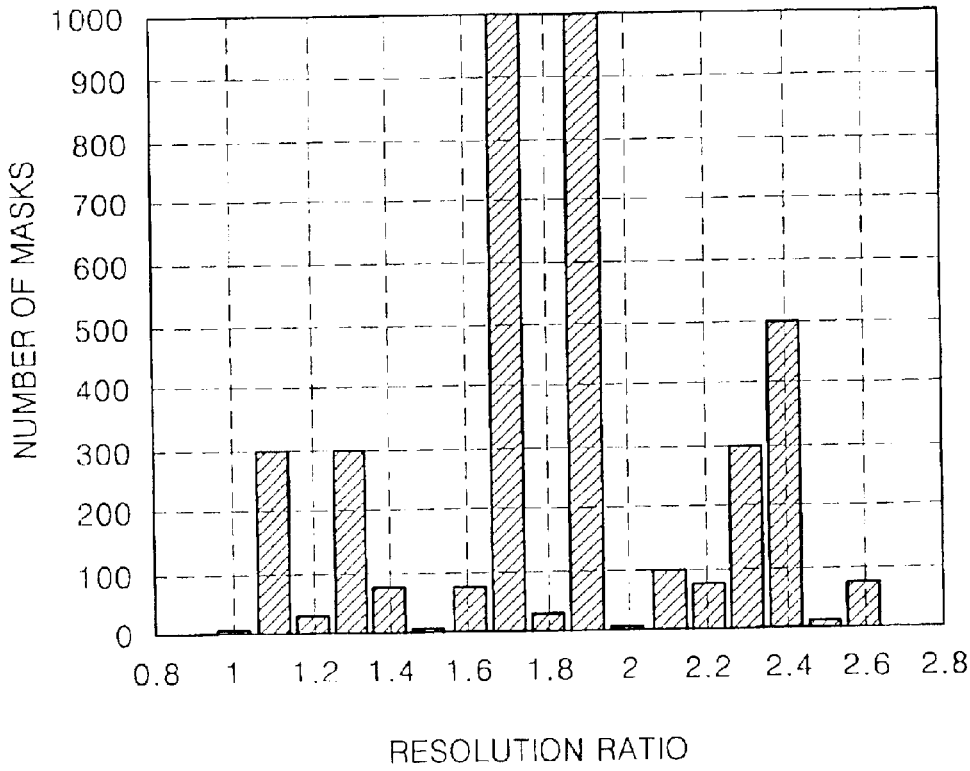
FIG. 14 is a graph of the number of masks with respect to a resolution ratio when the sub-pixel areas of a display panel have a striped structure.

FIG. 14 is a graph of the number of masks with respect to a resolution ratio when the sub-pixel areas of a display panel have a striped structure. In this case, a resolution ratio means a vertical resolution ratio and a horizontal resolution ratio which are the same. In the striped structure, red sub-pixel areas are positioned on a first line, green sub-pixel areas are positioned on a second line, and blue sub-pixel areas are positioned on a third line. The detailed data of the graph shown in FIG. 14 is shown in Tables 2A through 2C.

TABLE 2A

| resolution ratio | 1:1 | 1.1:1 | 1.2:1 | 1.3:1 | 1.4:1 | 1.5:1 |
|---|---|---|---|---|---|---|
| Number of masks | 3 | 300 | 25 | 300 | 75 | 4 |

TABLE 2B

| resolution ratio | 1.6:1 | 1.7:1 | 1.8:1 | 1.9:1 | 2.0:1 | 2.1:1 |
|---|---|---|---|---|---|---|
| Number of masks | 75 | Over 1000 | 25 | Over 1000 | 3 | 100 |

TABLE 2C

| resolution ratio | 2.2:1 | 2.3:1 | 2.4:1 | 2.5:1 | 2.6:1 | — |
|---|---|---|---|---|---|---|
| Number of masks | 75 | 300 | 500 | 12 | 75 | — |

A delta type structure of the sub-pixel areas of a display panel is more preferable than a striped structure because in a stripe type structure, the sub-pixels that are located on the up and down side of a certain sub-pixel are of the same color so that the first imaginary image cells which are vertically located of a certain sub-pixel and overlapped by a mask are less effective to the sub-pixel in the process of sub-pixel rendering than delta type structure.

Figure 15:
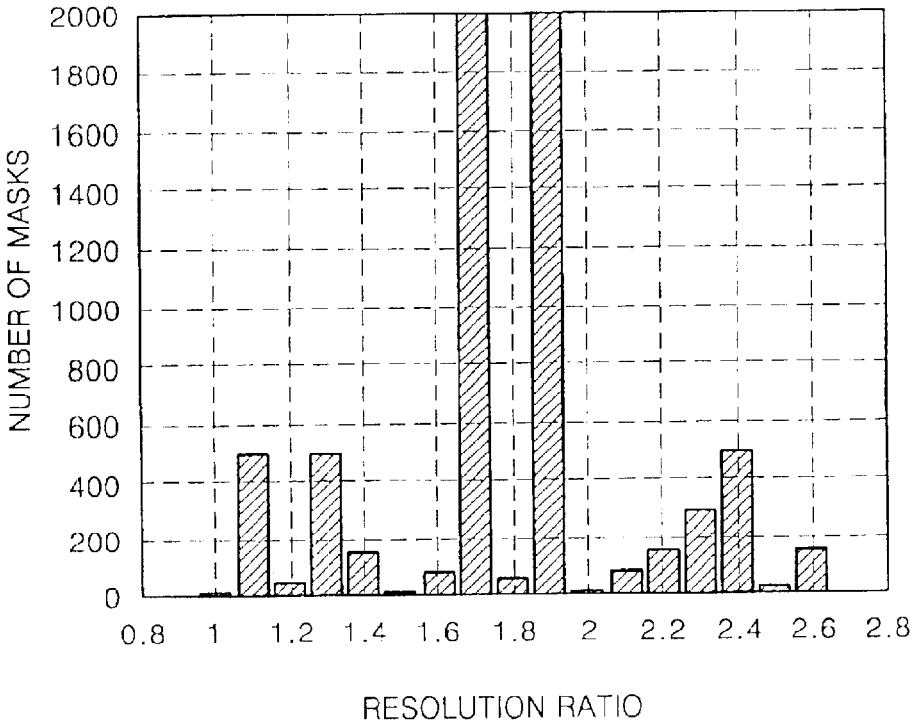
FIG. 15 is a graph of the number of masks with respect to a resolution ratio when the sub-pixel areas of a display panel have a delta structure.

FIG. 15 is a graph of the number of masks with respect to a resolution ratio when the sub-pixel areas of a display panel have a delta structure. In this case, a resolution ratio means a vertical resolution ratio and a horizontal resolution ratio which are the same. The detailed data of the graph shown in FIG. 15 is shown in Tables 3A through 3C.

TABLE 3A

| resolution ratio | 1:1 | 1.1:1 | 1.2:1 | 1.3:1 | 1.4:1 | 1.5:1 |
|---|---|---|---|---|---|---|
| Number of masks | 6 | 300 | 25 | 300 | 150 | 4 |

TABLE 3B

| resolution ratio | 1.6:1 | 1.7:1 | 1.8:1 | 1.9:1 | 2.0:1 | 2.1:1 |
|---|---|---|---|---|---|---|
| Number of masks | 75 | Over 2000 | 25 | Over 2000 | 3 | 100 |

TABLE 3C

| resolution ratio | 2.2:1 | 2.3:1 | 2.4:1 | 2.5:1 | 2.6:1 | — |
|---|---|---|---|---|---|---|
| Number of masks | 150 | 300 | 500 | 12 | 150 | — |

In the meantime, when a second virtual screen is superimposed on a first virtual screen, it is preferable that the central line of each pixel area on the first virtual screen is not the central line of each sub-pixel area on the second virtual screen. The reason will be described below.

Figure 16A:
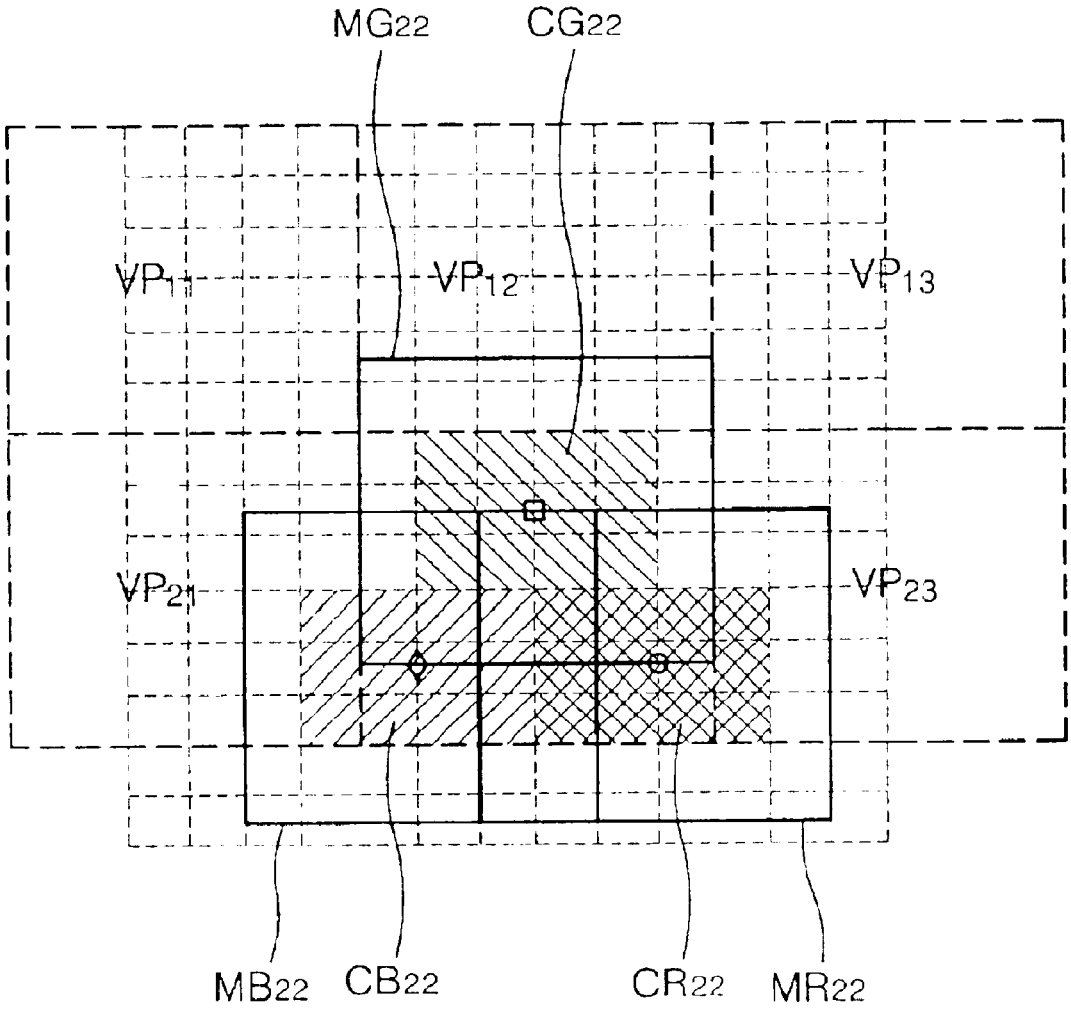
FIG. 16A shows a state in which the central line of a pixel area on a first virtual screen is the central line of a sub-pixel area on a second virtual screen.
Figure 16B:
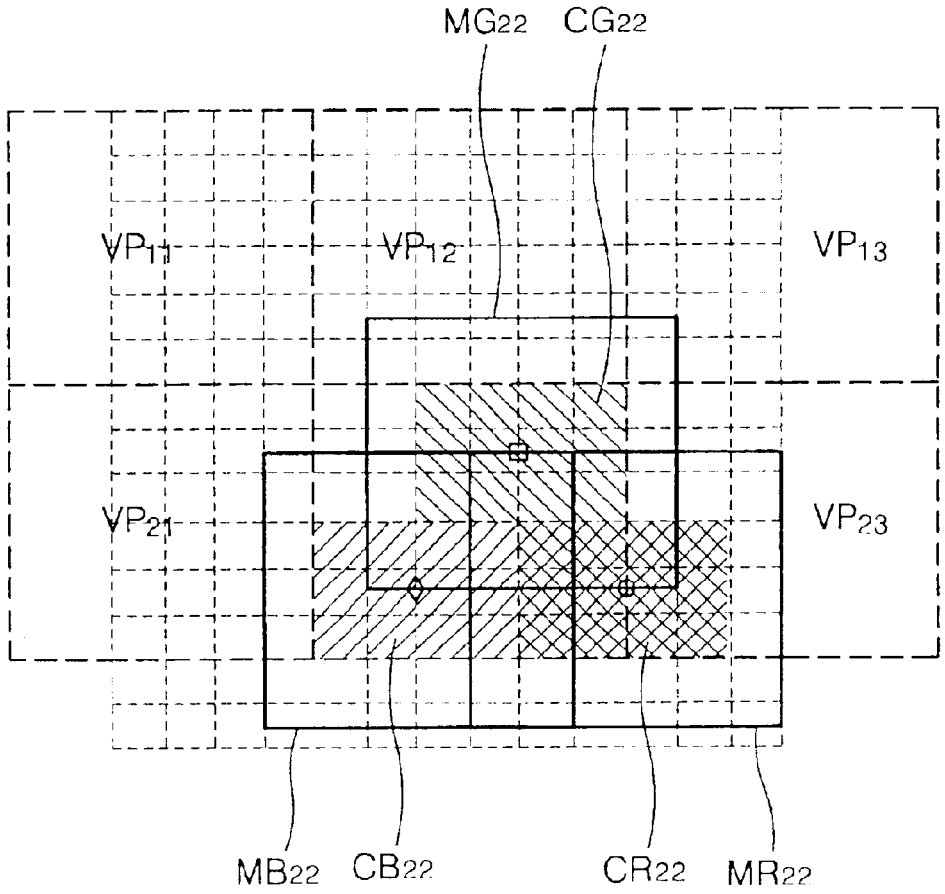
FIG. 16B shows a state in which the central line of a pixel area on a first virtual screen is not the central line of a sub-pixel area on a second virtual screen.

FIG. 16A shows a state in which the central line of a pixel area on a first virtual screen is the central line of a sub-pixel area on a second virtual screen. FIG. 16B shows a state in which the central line of a pixel area on a first virtual screen is not the central line of a sub-pixel area on a second virtual screen. In FIGS. 16A and 16B, reference characters $VP_{11}$ through $VP_{23}$ denote some pixel areas on the first virtual screen. A reference character $CR_{22}$ denotes a red sub-pixel area on the second virtual screen, a reference character $CG_{22}$ denotes a green sub-pixel area on the second virtual screen, and a reference character $CB_{22}$ denotes a blue sub-pixel area on the second virtual screen. A reference character $MR_{22}$ denotes a mask for the red sub-pixel area $CR_{22}$, a reference character $MG_{22}$ denotes a mask for the green sub-pixel area $CG_{22}$, and a reference character $MB_{22}$ denotes a mask for the blue sub-pixel area $CB_{22}$.

Referring to FIG. 16A, the central vertical line of a pixel area on the first virtual screen is the central vertical line of the green sub-pixel area $CG_{22}$ on the second virtual screen. When steps S4, S5, and S6 are performed in this state, a color error phenomenon in which green is visually conspicuous may occur. When green is conspicuous, a viewer may easily notice the color error phenomenon.

However, as shown in FIG. 16B, when the central vertical line of a pixel area on the first virtual screen is a middle line between the green and blue sub-pixel areas $CG_{22}$ and $CB_{22}$ on the second virtual screen, a mixture of green and blue, i.e., a shade of cyan, maybe visually conspicuous. When a shade of cyan is conspicuous, a viewer cannot easily recognize the color error phenomenon.

Similarly, when the central vertical line of a pixel area on the first virtual screen is a middle line between the red and blue sub-pixel areas $CR_{22}$ and $CB_{22}$ on the second virtual screen, a mixture of red and blue, i.e., a shade of magenta, may be visually conspicuous. When a shade of magenta is conspicuous, a viewer cannot easily recognize the color error phenomenon.

In the meantime, referring to FIGS. 8A and 12, when a ratio of the new resolution of the input image data to the resolution of the display panel is 1.5:1, the central vertical line of a pixel area on the first virtual screen $V_{SS}$ is not the central vertical line of a sub-pixel area on the second virtual screen $V_{DS}$.

The present invention is applicable to all types of display devices including for example plasma display panels (PDP), liquid crystal display (LCD) panels and ferroelectric liquid crystal (FLC) panels.

Figure 17:
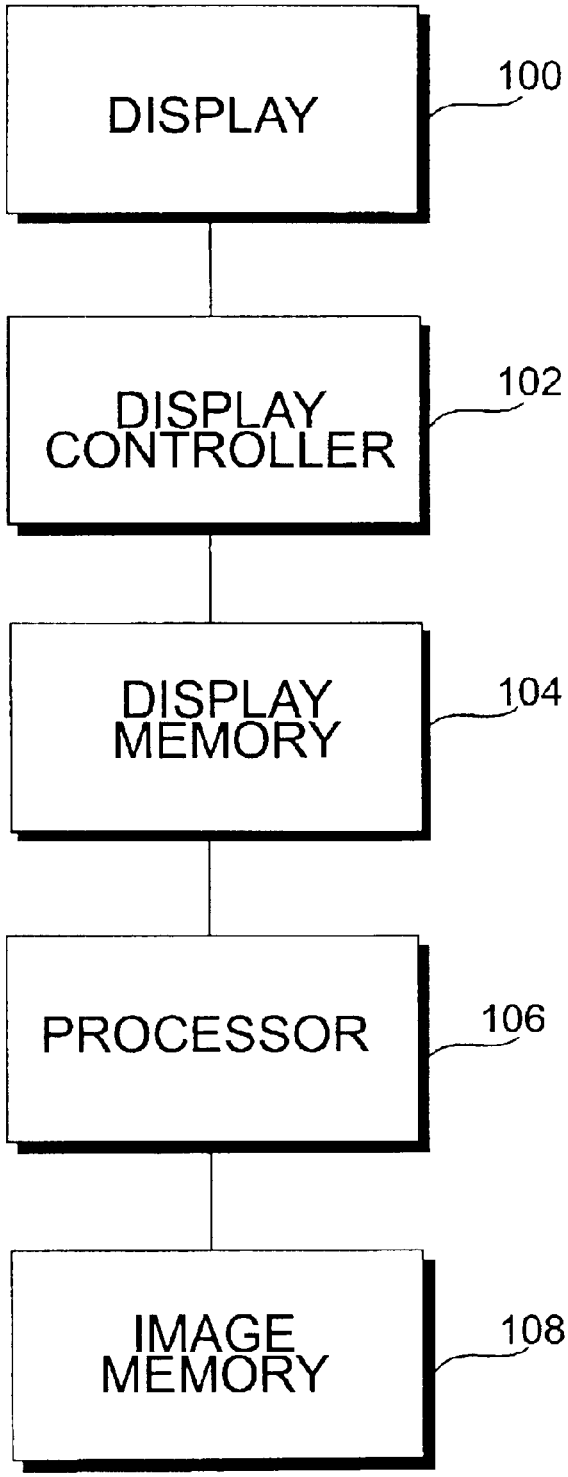
FIGS. 17 through 19 show examples of devices including displays using the techniques of the present invention.

Devices that can be used for applying the present invention can include for example televisions, computers, and other multimedia or telecommunication devices. For example, as seen in FIG. 17 a device for processing image data to generate output image data for driving a display panel according to the present invention can include the display panel such as a plasma display panel 100 connected to a display controller 102 and a display memory 104. The processor or controller 106 processes the image data stored in the image memory 108 and transfers the processed image data to the display memory 104 where the transferred data is managed by the display controller 102 for display on the display panel 100.

Figure 18:
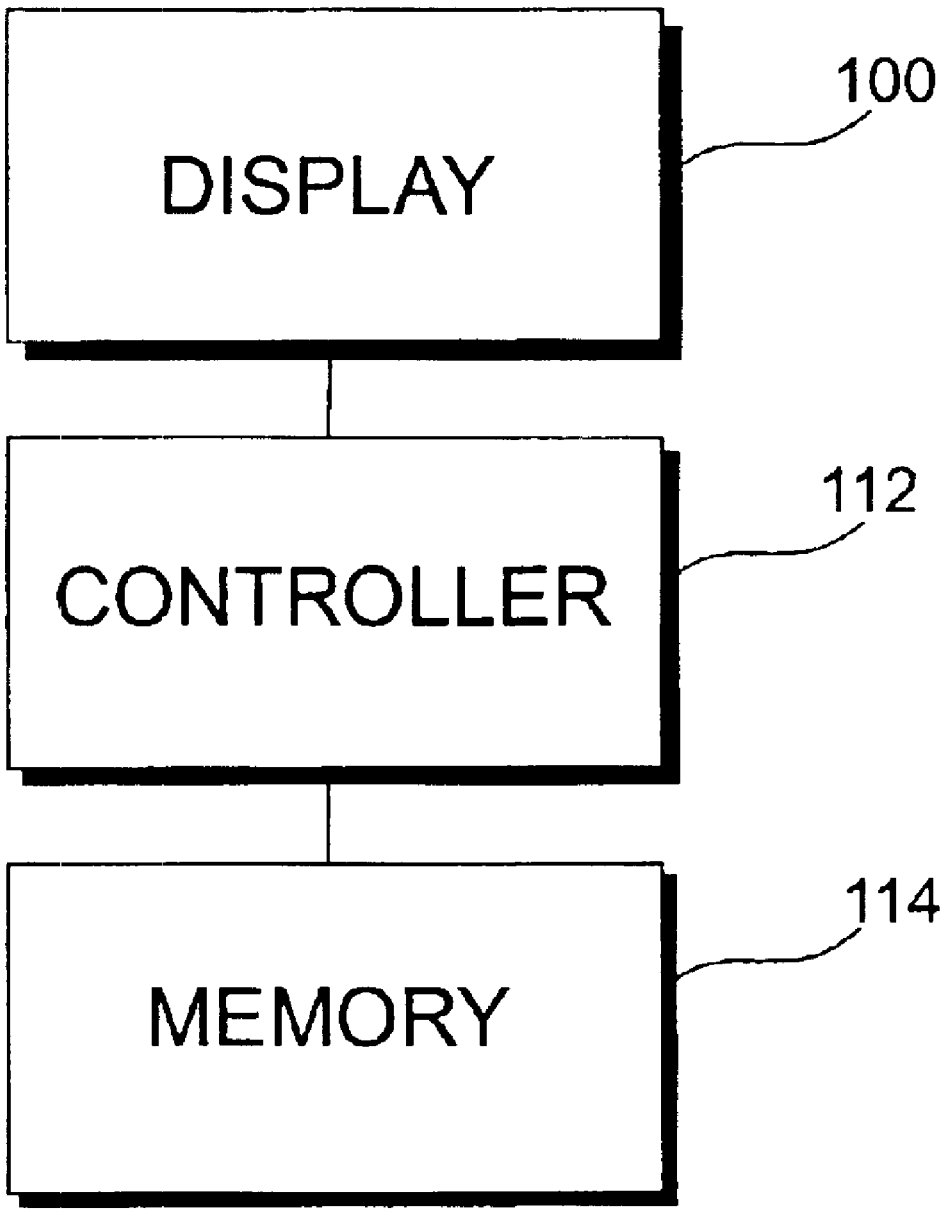

FIG. 18 shows another view of a device for processing image data to generate output image data for driving a display panel according to the present invention. The display panel 100 is controlled by controller 112 using memory or computer readable media 114 (e.g. non volatile read-only memory, random access memory, floppy disks, compact discs, digital versatile discs, hard disk drives, flash read-only memories, other optical and magnetic mediums, etc.).

Figure 19:
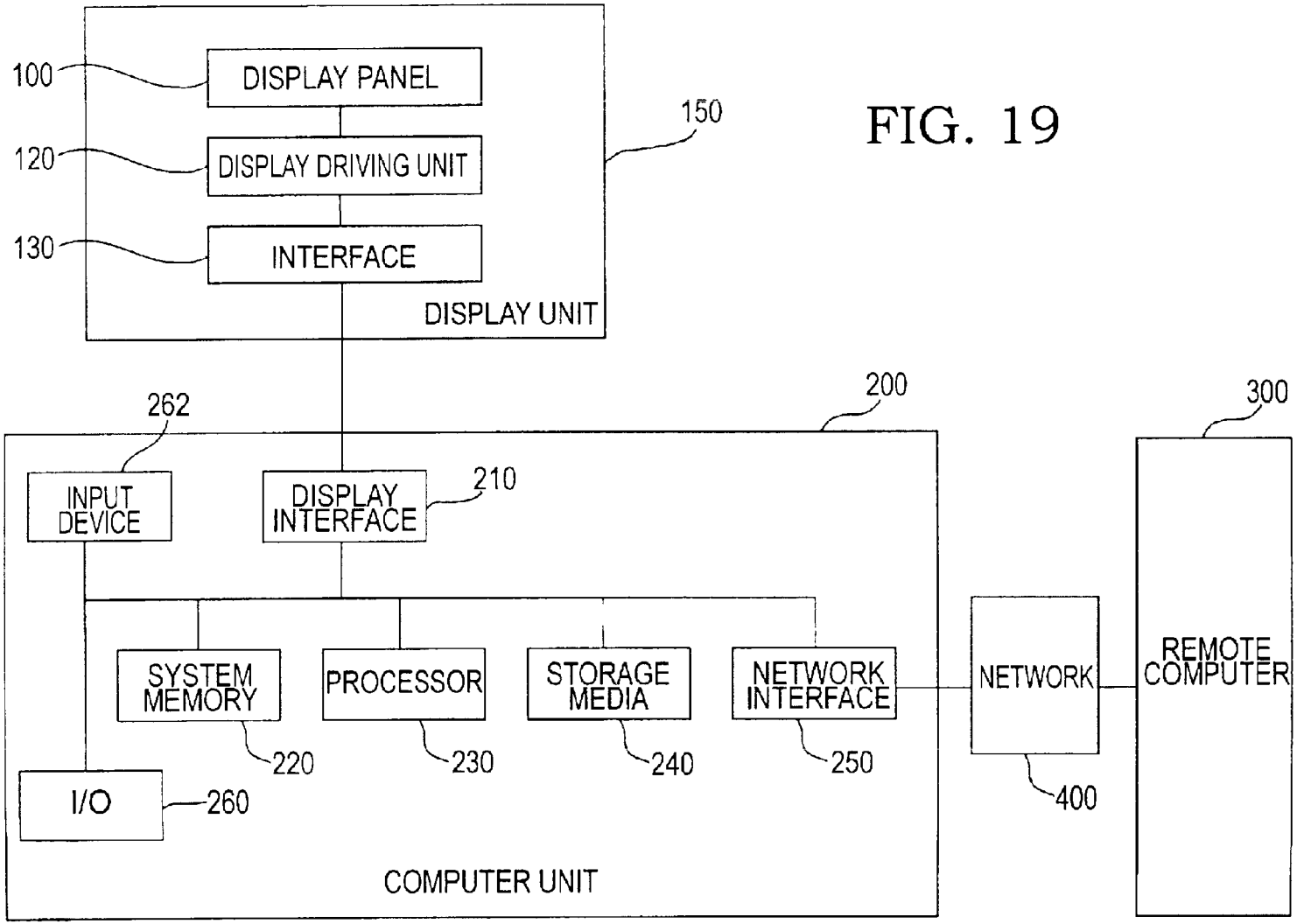

Referring to FIG. 19, another example of a device implementing the present invention is a display device unit 150 connected to a computer unit 200 and the computer unit 200 is connected to a remote computer 300. The display panel 100 such as a plasma display panel is driven by a display driving unit 120 and is connected to the computer unit 200 through the interface 130 of the display unit 150 and display interface 210 of the computer unit 200. Through a system bus, the display interface 210 is connected to computer readable media such as the system memory 220 (read-only memory, random access memory) and storage media 240

(floppy disks, compact discs, digital versatile discs, hard disk drives, flash read-only memories, other optical and magnetic mediums, etc.). The system bus also connects the computer processor 230 with the computer readable medium and includes inputs through input device 262 and other input and output devices 260. The computer unit 200 can also be connected to a remote computer 300 through a network interface 250 and a network 400 such as the Internet.

As described above, a method of processing image data according to the present invention has the following effects.

First, a new resolution for input image data can be set in order to maximize the number of masks having the same area ratio structures. Accordingly, the number of masks to be used is minimized, so the number of times area ratios are multiplied by transformed image data is minimized, thereby increasing display speed and decreasing necessary memory-capacity.

Second, each sub-pixel of a display panel is involved with the data of its adjacent pixels on a first virtual screen, so a problem in reproducing an image due to the sub-pixel array structure of the display panel can be radically solved.

In addition, a color error, which may occur during data processing, can be corrected.

The present invention is not restricted to the above-described embodiment, and it will be apparent that various changes can be made by those skilled in the art without departing from the spirit of the invention.

What is claimed is:

1. A method of processing image data to generate output image data for driving a display panel, the method comprising:

setting a new resolution for input image data according to a resolution of said display panel;

dividing a first virtual screen into a plurality of pixel areas according to said new resolution set for said input image data;

superimposing a second virtual screen including a sub-pixel array structure of said display panel on said first virtual screen;

laying a mask wider than a sub-pixel area on the superimposed second virtual screen on each sub-pixel area;

obtaining and setting an area ratio of the area of each pixel portion on said first virtual screen included in each mask to an area of said mask; and applying said new resolution and the area ratios to a driving device of said display panel, transforming said input image data having an original resolution into image data having said new resolution, and generating a sum of the results of multiplying area ratios of pixel portions on the first virtual screen in each mask by the transformed image data of the pixel areas, respectively, as output image data of the sub-pixel corresponding to said mask.

2. The method of claim 1, with the new resolution for the input image data being set to maximize the number of masks having the same area ratio structures.

3. The method of claim 2, with the setting of said new resolution comprising:

setting a new horizontal resolution for said input image data according to a horizontal resolution of said display panel; and setting a new vertical resolution for said input image data according to a vertical resolution of said display panel.

4. The method of claim 3, with said new horizontal resolution being set to accommodate a ratio of said new horizontal resolution for the input image data to said horizontal resolution of said display panel being one among 1:1, 1.5:1, and 2:1.

5. The method of claim 3, with said new vertical resolution being set to accommodate said new vertical resolution for said input image data to said vertical resolution of said display panel being one among 1:1, 1.2:1, 1.5:1, 1.6:1, and 2:1.

6. The method of claim 3, further comprised of said laying of said mask not including a next same color sub-pixel.

7. The method of claim 2, further comprised of the sub-pixel array structure being a delta structure.

8. The method of claim 1, further comprised of when said second virtual screen is superimposed on said first virtual screen, the central line of each pixel area on said first virtual screen not being the central line of each sub-pixel area on said second virtual screen.

9. The method of claim 1, further comprised of a shape of said masks being the same as said sub-pixels of said display panel.

10. The method of claim 1, further comprised of a shape of said masks being one among a quadrilateral, a hexagon, and a circle.

11. The method of claim 1, further comprised of a shape of said masks being one among a quadrilateral and a hexagon.

12. The method of claim 11, further comprised of when said second virtual screen is superimposed on said first virtual screen, the central line of each pixel area on said first virtual screen not being the central line of each sub-pixel area on said second virtual screen.

13. The method of claim 1, further comprised of the sub-pixel array structure including a delta structure.

14. The method of claim 1, with said display panel being a plasma display panel.

15. A method of processing image data to generate output image data for driving a display panel, the method comprising:

setting a new resolution for input image data according to a resolution of said display panel;

dividing a first virtual screen into a plurality of pixel areas according to said new resolution set for said input image data;

superimposing a second virtual screen including a sub-pixel array structure of said display panel on said first virtual screen;

laying a mask wider than a sub-pixel area on the superimposed second virtual screen on each sub-pixel area, said mask not covering any portion of a next same color sub-pixel area;

obtaining and setting an area ratio of the area of each pixel portion on said first virtual screen included in each mask to an area of said mask; and applying said new resolution and the area ratios to a driving device of said display panel, transforming said input image data having an original resolution into image data having said new resolution, and generating a sum of the results of multiplying area ratios of pixel portions on the first virtual screen in each mask by the transformed image data of the pixel areas, respectively, as output image data of the sub-pixel corresponding to said mask.

16. The method of claim 15, with the output image data of a certain sub-pixel generated according to:

$$\frac{\sum_{y=1}^{z} A_y \cdot b_y}{\sum_{y=1}^{z} A_y}$$

where A is an area of a portion of said mask, where z is the number of portions of said mask, and where b is the image data of a pixel area including the area A on the first virtual screen.

17. The method of claim 16, with the new resolution for the input image data being set to maximize the number of masks having the same area ratio structures.

18. The method of claim 17, with the setting of said new resolution comprising:

setting a new horizontal resolution for said input image data according to a horizontal resolution of said display panel; and setting a new vertical resolution for said input image data according to a vertical resolution of said display panel.

19. The method of claim 18, with said new horizontal resolution being set to accommodate a ratio of said new horizontal resolution for the input image data to said horizontal resolution of said display panel being one among 1:1, 1.5:1, and 2:1.

20. The method of claim 18, with said new vertical resolution being set to accommodate said new vertical resolution for said input image data to said vertical resolution of said display panel being one among 1:1, 1.2:1, 1.5:1, 1.6:1, and 2:1.

21. The method of claim 16, further comprised of when said second virtual screen is superimposed on said first virtual screen, the central line of each pixel area on said first virtual screen not being the central line of each sub-pixel area on said second virtual screen.

22. The method of claim 16, further comprised of a shape of said mask being the same as said sub-pixels of said display panel.

23. The method of claim 16, further comprised of a shape of said masks being one among a quadrilateral, a hexagon, and a circle.

24. The method of claim 16, further comprised of a shape of said masks being one among a quadrilateral and a hexagon.

25. The method of claim 24, further comprised of when said second virtual screen is superimposed on said first virtual screen, the central line of each pixel area on said first virtual screen not being the central line of each sub-pixel area on said second virtual screen.

26. The method of claim 16, further comprised of the sub-pixel array structure being a delta structure.

27. The method of claim 15, with said display panel being a plasma display panel.

28. A system for processing image data to generate output image data for driving a display panel, comprising:

a computer processor unit processing the image data;

a computer readable medium storing the image data;

a first unit initializing said computer readable medium;

a second unit setting a new resolution for input image data according to a resolution of said display panel;

a third unit dividing a first virtual screen into a plurality of pixel areas according to said new resolution set for said input image data;

a fourth unit superimposing a second virtual screen including a sub-pixel array structure of said display panel on said first virtual screen;

a fifth unit laying a mask wider than a sub-pixel area on the superimposed second virtual screen on each sub-pixel area;

a sixth unit obtaining and setting an area ratio of the area of each pixel portion on said first virtual screen included in each mask to an area of said mask; and a seventh unit applying said new resolution and the area ratios to a driving device of said display panel, transforming said input image data having an original resolution into image data having said new resolution, and generating a sum of the results of multiplying area ratios of pixel portions on the first virtual screen in each mask by the transformed image data of the pixel areas, respectively, as output image data of the sub-pixel corresponding to said mask.

29. The system of claim 28, with the output image data of a certain sub-pixel generated according to:

$$\frac{\sum_{y=1}^{z} A_y \cdot b_y}{\sum_{y=1}^{z} A_y}$$

where A is an area of a portion of said mask, where z is the number of portions of said mask, and where b is the image data of a pixel area including the area A on the first virtual screen.

30. The system of claim 29, with the new resolution for the input image data being set to maximize the number of masks having the same area ratio structures.

31. The system of claim 30, with said second unit setting of said new resolution comprising:

setting a new horizontal resolution for said input image data according to a horizontal resolution of said display panel; and setting a new vertical resolution for said input image data according to a vertical resolution of said display panel.

32. The system of claim 31, with said new horizontal resolution being set to accommodate a ratio of said new horizontal resolution for the input image data to said horizontal resolution of said display panel being one among 1:1, 1.5:1, and 2:1.

33. The system of claim 32, with said new vertical resolution being set to accommodate said new vertical resolution for said input image data to said vertical resolution of said display panel being one among 1:1, 1.2:1, 1.5:1, 1.6:1, and 2:1.

34. The system of claim 33, further comprised of said fourth unit including when said second virtual screen is superimposed on said first virtual screen, the central line of each pixel area on said first virtual screen not being the central line of each sub-pixel area on said second virtual screen.

35. The system of claim 34, further comprised of a shape of said masks being the same as said sub-pixels of said display panel.

36. The system of claim 34, further comprised of a shape of said masks being one among a quadrilateral, a hexagon, and a circle.

37. The system of claim 34, further comprised of a shape of said masks being one among a quadrilateral and a hexagon.

38. The system of claim 37, further comprised of when said second virtual screen is superimposed on said first virtual screen, the central line of each pixel area on said first virtual screen not being the central line of each sub-pixel area on said second virtual screen.

39. The system of claim 28, further comprised of the sub-pixel array structure being a delta structure.

40. The system of claim 28, with said display panel being a plasma display panel.

41. The system of claim 28, further comprised of said laying of said mask not including a next same color sub-pixel.

42. A system for processing image data to generate output image data for driving a display panel, comprising:

a computer readable medium;

a processor connected to said computer readable medium, said processor programmed to:

setting a new resolution for input image data according to a resolution of said display panel;

dividing a first virtual screen into a plurality of pixel areas according to said new resolution set for said input image data;

superimposing a second virtual screen including a sub-pixel array structure of said display panel on said first virtual screen;

laying a mask wider than a sub-pixel area on the superimposed second virtual screen on each sub-pixel area;

obtaining and setting an area ratio of the area of each pixel portion on said first virtual screen included in each mask to an area of said mask; and applying said new resolution and the area ratios to a driving device of said display panel, transforming said input image data having an original resolution into image data having said new resolution, and generating a sum of the results of multiplying area ratios of pixel portions on the first virtual screen in each mask by the transformed image data of the pixel areas, respectively, as output image data of the sub-pixel corresponding to said mask.

43. The system of claim 42, with the new resolution for the input image data being set to maximize the number of masks having the same area ratio structures.

44. The system of claim 43, with the setting of said new resolution comprising:

setting a new horizontal resolution for said input image data according to a horizontal resolution of said display panel; and setting a new vertical resolution for said input image data according to a vertical resolution of said display panel.

45. The system of claim 42, with said new horizontal resolution being set to accommodate a ratio of said new horizontal resolution for the input image data to said horizontal resolution of said display panel being one among 1:1, 1.5:1, and 2:1.

46. The system of claim 45, with said new vertical resolution being set to accommodate said new vertical resolution for said input image data to said vertical resolution of said display panel being one among 1:1, 1.2:1, 1.5:1, 1.6:1, and 2:1.

47. The system of claim 42, further comprised of when said second virtual screen is superimposed on said first virtual screen, the central line of each pixel area on said first virtual screen not being the central line of each sub-pixel area on said second virtual screen.

48. The system of claim 42, further comprised of a shape of said masks being the same as said sub-pixels of said display panel.

49. The system of claim 42, further comprised of a shape of said masks being one among a quadrilateral, a hexagon, and a circle.

50. The system of claim 42, further comprised of a shape of said masks being one among a quadrilateral and a hexagon.

51. The system of claim 50, further comprised of when said second virtual screen is superimposed on said first virtual screen, the central line of each pixel area on said first virtual screen not being the central line of each sub-pixel area on said second virtual screen.

52. A computer-readable medium having computer-executable instructions for performing a method, comprising:

setting a new resolution for input image data according to a resolution of said display panel;

dividing a first virtual screen into a plurality of pixel areas according to said new resolution set for said input image data;

superimposing a second virtual screen including a sub-pixel array structure of said display panel on said first virtual screen;

laying a mask on the superimposed second virtual screen on each sub-pixel area;

obtaining and setting an area ratio of the area of each pixel portion on said first virtual screen included in each mask to an area of said mask; and applying said new resolution and the area ratios to a driving device of said display panel, transforming said input image data having an original resolution into image data having said new resolution, and generating a sum of the results of multiplying area ratios of pixel portions on the first virtual screen in each mask by the transformed image data of the pixel areas, respectively, as output image data of the sub-pixel corresponding to said mask.

53. The computer-readable medium of claim 52, with the output image data of a certain sub-pixel generated according to:

$$\frac{\sum_{y=1}^{z} A_y \cdot b_y}{\sum_{y=1}^{z} A_y}$$

where A is an area of a portion of said mask, where z is the number of portions of said mask, and where b is the image data of a pixel area including the area A on the first virtual screen.

54. The computer-readable medium of claim 53, with the new resolution for the input image data being set to maximize the number of masks having the same area ratio structures.

55. The computer-readable medium of claim 54, with said second unit setting of said new resolution comprising:

setting a new horizontal resolution for said input image data according to a horizontal resolution of said display panel; and setting a new vertical resolution for said input image data according to a vertical resolution of said display panel.

56. A computer-readable medium having stored thereon a data structure comprising:

a first field containing data representing a new resolution for input image data according to a resolution of a plasma display panel;

a second field containing data representing a dividing of a first virtual screen into a plurality of pixel areas according to said new resolution set for said input image data;

a third field containing data representing a superimposing of a second virtual screen including a sub-pixel array structure of said plasma display panel on said first virtual screen;

a fourth field containing data representing laying a mask on the superimposed second virtual screen on each sub-pixel area, said mask not covering any portion of a next same color sub-pixel area;

a fifth field containing data representing obtaining and setting an area ratio of the area of each pixel portion on said first virtual screen included in each mask to an area of said mask; and a sixth field containing data representing applying said new resolution and the area ratios to a driving device of said plasma display panel, transforming said input image data having an original resolution into image data having said new resolution, and generating a sum of the results of multiplying area ratios of pixel portions on the first virtual screen in each mask by the transformed image data of the pixel areas, respectively, as output image data of the sub-pixel corresponding to said mask.

57. A method of processing image data to generate output image data for driving a plasma display panel, the method comprising:

dividing a first virtual screen into a plurality of pixel areas according to a new resolution generated from an original resolution for said input image data;

superimposing a second virtual screen including a delta type sub-pixel array structure of said plasma display panel on said first virtual screen;

laying a mask wider than a sub-pixel area on the superimposed second virtual screen on each sub-pixel area, said mask not covering a portion of a next same color sub-pixel area;

setting an area ratio of the area of each pixel portion on said first virtual screen included in each mask to an area of said mask; and applying said new resolution and the area ratios to a driving device of said plasma display panel, transforming said input image data having an original resolution into image data having said new resolution, and generating a sum of the results of multiplying area ratios of pixel portions on the first virtual screen in each mask by the transformed image data of the pixel areas, respectively, as output image data of the sub-pixel corresponding to said mask.

* * * * *